US009422142B2

(12) United States Patent
Bacon et al.

(10) Patent No.: US 9,422,142 B2
(45) Date of Patent: Aug. 23, 2016

(54) SCISSOR-TYPE LIFT ASSEMBLY

(71) Applicant: Herkules Equipment Corporation, Walled Lake, MI (US)

(72) Inventors: Todd J. Bacon, Northville, MI (US); Robert M. Amundson, Howell, MI (US); Scott F. Wilhelm, Brighton, MI (US)

(73) Assignee: HERKULES EQUIPMENT CORPORATION, Walled Lake, MI (US)

( * ) Notice: Subject to any disclaimer, the term of this patent is extended or adjusted under 35 U.S.C. 154(b) by 408 days.

(21) Appl. No.: 13/956,859

(22) Filed: Aug. 1, 2013

(65) Prior Publication Data

US 2015/0034893 A1 Feb. 5, 2015

(51) Int. Cl.

| | |
|---|---|
| ***B66F 7/06*** | (2006.01) |
| ***B66F 3/22*** | (2006.01) |
| ***B66F 7/28*** | (2006.01) |
| ***B66F 3/46*** | (2006.01) |

(52) U.S. Cl.

CPC ..... *B66F 7/0658* (2013.01); *B66F 3/46* (2013.01); *B66F 3/22* (2013.01); *B66F 7/28* (2013.01)

(58) Field of Classification Search

CPC ..... B66F 7/0658; B66F 3/46; B66F 3/22; B66F 7/28

USPC ..... 248/155.2

See application file for complete search history.

(56) References Cited

U.S. PATENT DOCUMENTS

| | | | |
|---|---|---|---|
| 1,991,255 | A | 2/1935 | Martin |
| 2,132,343 | A | 10/1938 | Jarrett |

(Continued)

FOREIGN PATENT DOCUMENTS

| | | | |
|---|---|---|---|
| DE | 2008788 | A1 | 10/1971 |
| DE | 3340883 | A1 | 5/1985 |

(Continued)

OTHER PUBLICATIONS

Enkon Pro | Belt Drive Scissor Lift Tables, Copyright 2009-2013 Encron Systems Inc. http://www.enkon.pro/belt-drive-scissor-lift-tables.html.*

(Continued)

*Primary Examiner* — Moshe Wilensky
*Assistant Examiner* — Mahdi H Nejad
(74) *Attorney, Agent, or Firm* — Howard & Howard Attorneys PLLC

(57) ABSTRACT

The subject invention includes a lift system including a first scissor-type lift assembly and a second scissor-type lift assembly spaced from the first scissor-type lift assembly. The first scissor-type lift assembly includes a first base and a first platform coupled to the first base for movement between elevated and lowered states. The first scissor-type lift assembly includes a first motor operatively mounted to the first base. The second scissor-type lift assembly includes a second base and a second platform coupled to the second base for movement between elevated and lowered states. The second scissor-type lift assembly includes a second motor operatively mounted to the second base. The first and second motors move the first and second platforms between the elevated and lowered states. The lift system includes a controller in communication with the first and second scissor-type lift assemblies to synchronize operation of the first and second motors.

15 Claims, 13 Drawing Sheets

(56) References Cited

U.S. PATENT DOCUMENTS

| | | | | |
|---|---|---|---|---|
| 3,785,462 | A | 1/1974 | Coad et al. | |
| 3,901,356 | A | 8/1975 | Butler | |
| 4,219,186 | A | 8/1980 | Brewer | |
| 4,427,093 | A | 1/1984 | Wehmeyer et al. | |
| 4,534,544 | A | 8/1985 | Heide | |
| 4,577,821 | A | 3/1986 | Edmo et al. | |
| 4,619,346 | A | 10/1986 | Deguerry | |
| 4,858,482 | A | 8/1989 | Knudsen | |
| 4,872,800 | A | 10/1989 | Gutov et al. | |
| 4,899,987 | A | 2/1990 | Craig | |
| 4,905,496 | A | 3/1990 | Venalainen | |
| 4,921,074 | A | 5/1990 | Ochs | |
| 5,149,242 | A | 9/1992 | Haymore | |
| 5,269,118 | A * | 12/1993 | Bullaro | B65B 59/00 403/320 |
| 5,299,906 | A | 4/1994 | Stone | |
| 5,322,143 | A | 6/1994 | Curran | |
| 5,445,353 | A * | 8/1995 | Sakamoto | A61D 3/00 108/10 |
| 5,513,723 | A | 5/1996 | Luebke | |
| 5,636,711 | A | 6/1997 | Nussbaum | |
| 5,695,173 | A | 12/1997 | Ochoa et al. | |
| 5,722,513 | A | 3/1998 | Rowan et al. | |
| 5,934,414 | A | 8/1999 | Staczek | |
| 6,092,788 | A | 7/2000 | Simon | |
| 6,187,449 | B1 | 2/2001 | Sasaki et al. | |
| 6,209,944 | B1 | 4/2001 | Billiu et al. | |
| 6,257,372 | B1 * | 7/2001 | Schirmer | B66B 9/0853 187/269 |
| 6,286,629 | B1 | 9/2001 | Saunders | |
| 6,305,499 | B1 | 10/2001 | Jones et al. | |
| 6,371,247 | B1 | 4/2002 | Nedderman, Jr. | |
| 6,405,833 | B1 | 6/2002 | Baranda et al. | |
| 6,464,205 | B2 | 10/2002 | Wanner | |
| 6,537,017 | B2 | 3/2003 | Stone | |
| 6,591,945 | B1 | 7/2003 | Kigawa et al. | |
| 6,598,859 | B1 * | 7/2003 | Kureck | B66C 13/23 254/292 |
| 6,601,430 | B2 | 8/2003 | McClellan | |
| 6,601,826 | B1 | 8/2003 | Granata | |
| 6,619,433 | B1 | 9/2003 | Robert et al. | |
| 6,634,462 | B2 | 10/2003 | Byeong-Ho | |
| 6,640,934 | B1 | 11/2003 | Edwards | |
| 6,672,430 | B2 | 1/2004 | Boucher et al. | |
| 6,679,479 | B1 | 1/2004 | Watkins | |
| 6,701,770 | B2 | 3/2004 | McClellan et al. | |
| 6,705,238 | B1 | 3/2004 | Heckert | |
| 6,742,768 | B2 | 6/2004 | Alba | |
| 6,772,861 | B2 | 8/2004 | Vignoli | |
| 6,779,635 | B1 | 8/2004 | Anibas | |
| 6,814,188 | B1 | 11/2004 | Heckert | |
| 6,817,449 | B2 | 11/2004 | Berends | |
| 6,820,456 | B2 | 11/2004 | McClellan et al. | |
| 6,854,715 | B2 | 2/2005 | Hicks et al. | |
| 6,974,123 | B2 * | 12/2005 | Latvys | B66F 7/08 254/122 |
| 7,070,167 | B1 | 7/2006 | Bacon et al. | |
| 7,117,977 | B2 | 10/2006 | Abe | |
| 7,137,431 | B2 | 11/2006 | Ederer et al. | |
| 7,163,087 | B2 | 1/2007 | Putnam | |
| 7,213,686 | B2 | 5/2007 | Kaufman | |
| 7,225,901 | B2 | 6/2007 | Mustalahti et al. | |
| 7,331,425 | B2 | 2/2008 | Bukowski et al. | |
| 7,383,923 | B2 | 6/2008 | Patten et al. | |
| 7,413,056 | B2 | 8/2008 | Gonzi et al. | |
| 7,461,722 | B2 | 12/2008 | Kyotani | |
| 7,506,725 | B2 | 3/2009 | Kuo et al. | |
| 7,641,177 | B2 | 1/2010 | Rawdon | |
| 7,690,473 | B2 | 4/2010 | Hammonds | |
| 7,731,013 | B2 | 6/2010 | Milner et al. | |
| 7,905,302 | B2 | 3/2011 | Hammonds | |
| 8,052,120 | B2 * | 11/2011 | Bacon | B66F 7/0625 180/168 |
| 8,141,851 | B2 | 3/2012 | Manev et al. | |
| 8,662,477 | B2 * | 3/2014 | Bacon | B66F 7/065 254/122 |
| 2003/0189194 | A1 * | 10/2003 | Latvys | B66F 7/08 254/9 C |
| 2003/0196474 | A1 | 10/2003 | McClellan et al. | |
| 2004/0200258 | A1 | 10/2004 | Hess | |
| 2004/0262490 | A1 | 12/2004 | King, Jr. | |
| 2006/0037518 | A1 | 2/2006 | Lopez Alba | |
| 2008/0169158 | A1 | 7/2008 | Lam | |
| 2008/0224107 | A1 * | 9/2008 | Polins | B66B 9/16 254/45 |
| 2011/0139548 | A1 * | 6/2011 | Bacon | B66F 7/065 187/269 |
| 2011/0139549 | A1 * | 6/2011 | Bacon | B66D 1/02 187/269 |
| 2011/0240409 | A1 * | 10/2011 | Bacon | B66F 7/065 187/269 |
| 2012/0241698 | A1 | 9/2012 | Swasey et al. | |

FOREIGN PATENT DOCUMENTS

| | | | |
|---|---|---|---|
| EP | 0430410 | A1 * | 10/1990 |
| EP | 0501254 | A2 | 9/1992 |
| WO | WO2011/022947 | * | 3/2011 |

OTHER PUBLICATIONS belt-drive-scissor-lift-tables (Enkon Webpage); Encon by herkules; Copyright © 2009-2013 EnKon Systems Inc.*

English language translation for DE 2008788 extracted from espacenet.com database on Aug. 14, 2013, 2 pages.

English abstract and language translation for DE 3340883 extracted from espacenet.com database on Aug. 14, 2013, 5 pages.

English abstract and language translation for EP 0501254 extracted from espacenet.com database on Aug. 7, 2013, 5 pages.

Series 35 Double Long Scissor Lift Tables—Higher Capacities and Load Stability for Longer Loads! extracted from www.Autoquip.com on Aug. 19, 2013, 5 pages.

* cited by examiner

SCISSOR-TYPE LIFT ASSEMBLY

BACKGROUND OF THE INVENTION

1. Field of the Invention

The present invention generally relates to lift assemblies.

2. Description of Related Art

Transportation systems such as lift systems are well known for moving items or people between two vertically differing locations. Transportation systems such as conveyor assemblies are well known for moving items or people between two horizontally differing locations. It is also known to move the platform or carriage of these systems through a belt-driven apparatus.

One well-known and useful type of lift system is the scissor-type lift assembly, which includes a pair of scissor arms coupled to a platform with the pair of scissor arms pivoting as the platform is moved between an elevated state and a lowered state. Such lift systems are commonly driven through hydraulic cylinders connected to a single hydraulic pump.

Some lift systems, including the pair of scissor arms, can be susceptible to wear due to flexing and undesired movement of the pair of scissors during operation. Each of the pair of scissor arms pivot about a shaft as a platform moves between elevated and lowered states. The shaft can flex or move as the pair scissor arms pivot, which can lead to wear to the shaft and the pair of scissor arms.

SUMMARY OF THE INVENTION AND ADVANTAGES

The subject invention includes a lift system including a first scissor-type lift assembly and a second scissor-type lift assembly. The first scissor-type lift assembly includes a first base and a first platform coupled to the first base for movement between elevated and lowered states in which the first platform and the first base are distant and proximate, respectively. The first scissor-type lift assembly includes a first and second pair of scissor arms each having upper and lower ends respectively coupled to each of the first platform and the first base. The first and second pair of scissor arms are connected to each other intermediate their respective upper and lower ends about a first pivot axis for pivoting relative to each other during the movement of the first platform between the elevated and lowered states. The first scissor-type lift assembly includes a first guide arrangement mounted to the first and second pair of scissor arms to define a first path with the first guide arrangement being movable with the first and second pair of scissor arms during the movement of the first platform. The first scissor-type lift assembly includes a first spool coupled to the first base and defining a first spool axis. The first scissor-type lift assembly includes a first belt routed through the first path of the first guide arrangement with the first belt having a primary end engaged with the first spool onto which the first belt is wound and from which the first belt is unwound. The first scissor-type lift assembly includes a first motor mounted to the first base and operatively coupled to the first spool to wind and unwind the first belt through the first path to move the first and second pair of scissor arms and move the first platform between the elevated and lowered states.

The second scissor-type lift assembly includes a second base and a second platform coupled to the second base for movement between elevated and lowered states in which the second platform and the second base are distant and proximate, respectively. The second scissor-type lift assembly includes a third and fourth pair of scissor arms each having upper and lower ends respectively coupled to each of the second platform and the second base. The third and fourth pair of scissor arms connected to each other intermediate their respective upper and lower ends about a second pivot axis for pivoting relative to each other during the movement of the second platform between the elevated and lowered states. The second scissor-type lift assembly includes a second guide arrangement mounted to the third and fourth pair of scissor arms independent from the first guide arrangement to define a second path with the second guide arrangement being movable with the third and fourth pair of scissor arms during the movement of the second platform. The second scissor-type lift assembly includes a second spool coupled to the second base and defining a second spool axis. The second scissor-type lift assembly includes a second belt routed through the second path defined by the second guide arrangement with the second belt spaced from the first belt and having a primary end engaged with the second spool onto which the second belt is wound and from which the second belt is unwound. The second scissor-type lift assembly includes a second motor mounted to the second base and operatively coupled to the second spool to wind and unwind the second belt independently from the first motor through the second path to move the third and fourth pair of scissor arms and move the second platform between the elevated and lowered states.

The lift system includes a controller in communication with the first and second motors to synchronize operation of the first and second motors for moving the first and second platforms between the associated elevated and lowered states in synchronization.

The first scissor-type lift assembly includes a first shaft disposed along the first pivot axis and the second scissor-type lift assembly includes a first shaft disposed along the second pivot axis. The first shaft having a first end and a second end spaced from the first end along the first pivot axis with the first and third pair of scissor arms pivotably disposed about the first shaft. The first and second ends extending from the first and third pair of scissor arms with the second end terminating at a first shaft face. Both of the first and second scissor-type lift assemblies of the lift system include a first retention device coupled to the first end of the first shaft with the first retention device engaging one scissor arm of the first and third pair of scissor arms.

The first scissor-type lift assembly includes a second shaft disposed along the first pivot axis and the second scissor-type lift assembly includes a second shaft disposed along the second pivot axis. The second shaft having a third end and a fourth end spaced from the third end along the second pivot axis with the second and fourth pair of scissor arms pivotably disposed about the second shaft. The third and fourth ends extending from the second and fourth pair of scissor arms with the fourth end terminating at a second shaft face.

The first and second scissor-type lift assemblies of the lift system include a second retention device coupled to the third end of the second shaft with the second retention device engaging one of the scissor arms of the second and fourth pair of scissor arms. Both of the first and second scissor-type lift assemblies of the lift system include a first brace fixed to another one of the first and third pair of scissor arms with the first brace abutting the first shaft face of the first shaft to maintain alignment of the first shaft along the first and second pivot axes for reducing wear between the first and third pivot axes and the first and third pair of scissor arms. Both of the first and second scissor-type lift assemblies of the lift system include a second brace fixed to another one of the second and fourth pair of scissor arms with the second brace abutting the second shaft face of the second shaft to maintain alignment of the second shaft along the first and second pivot axes for reducing wear between the first and second pivot axes and the second and fourth pair of scissor arms.

Advantageously, since the first motor of the first scissor-type lift assembly and the second motor of the second scissor-type lift assembly are in communication with and controlled by the controller, the lift system may be precisely controlled. Further, the force is divided between the first and second motors to allow a reduction in motor size. Additionally, since the first and second braces abut the first and second shafts to maintain alignment of the first and second shafts along the first and second pivot axes, wear to the shafts and the pairs of scissor arms is reduced as the pair of scissor arms pivot.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
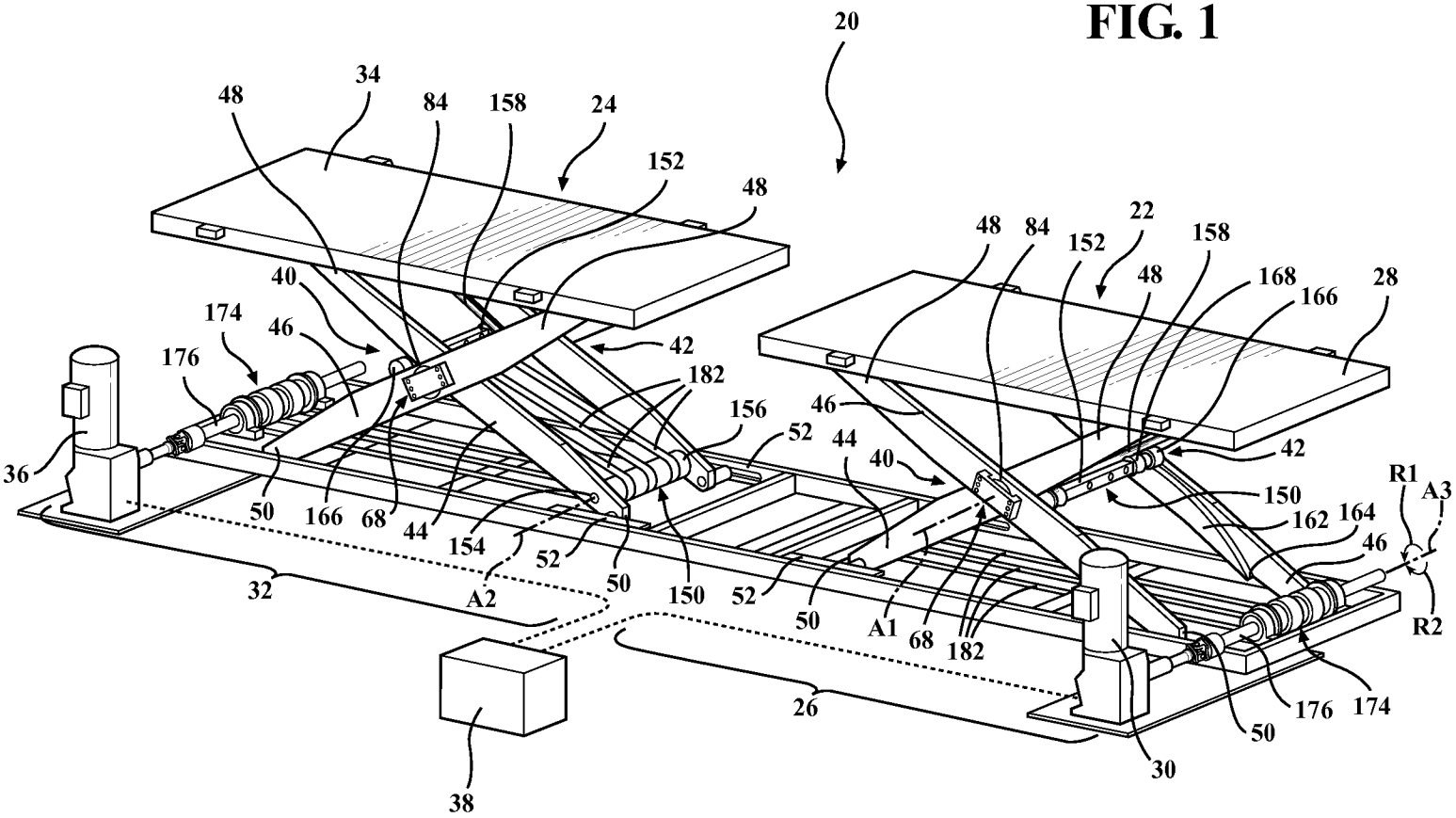
FIG. 1 is a perspective view of a lift system having a first scissor-type lift assembly and a second scissor-type lift assembly with the lift system shown in an elevated state.

Referring to the Figures wherein like numerals indicate like or corresponding parts throughout the several views, a lift system 20 including a first scissor-type lift assembly 22 and a second scissor-type lift assembly 24 spaced from the first scissor-type lift assembly 22 is generally shown in FIG. 1.

Figure 2:
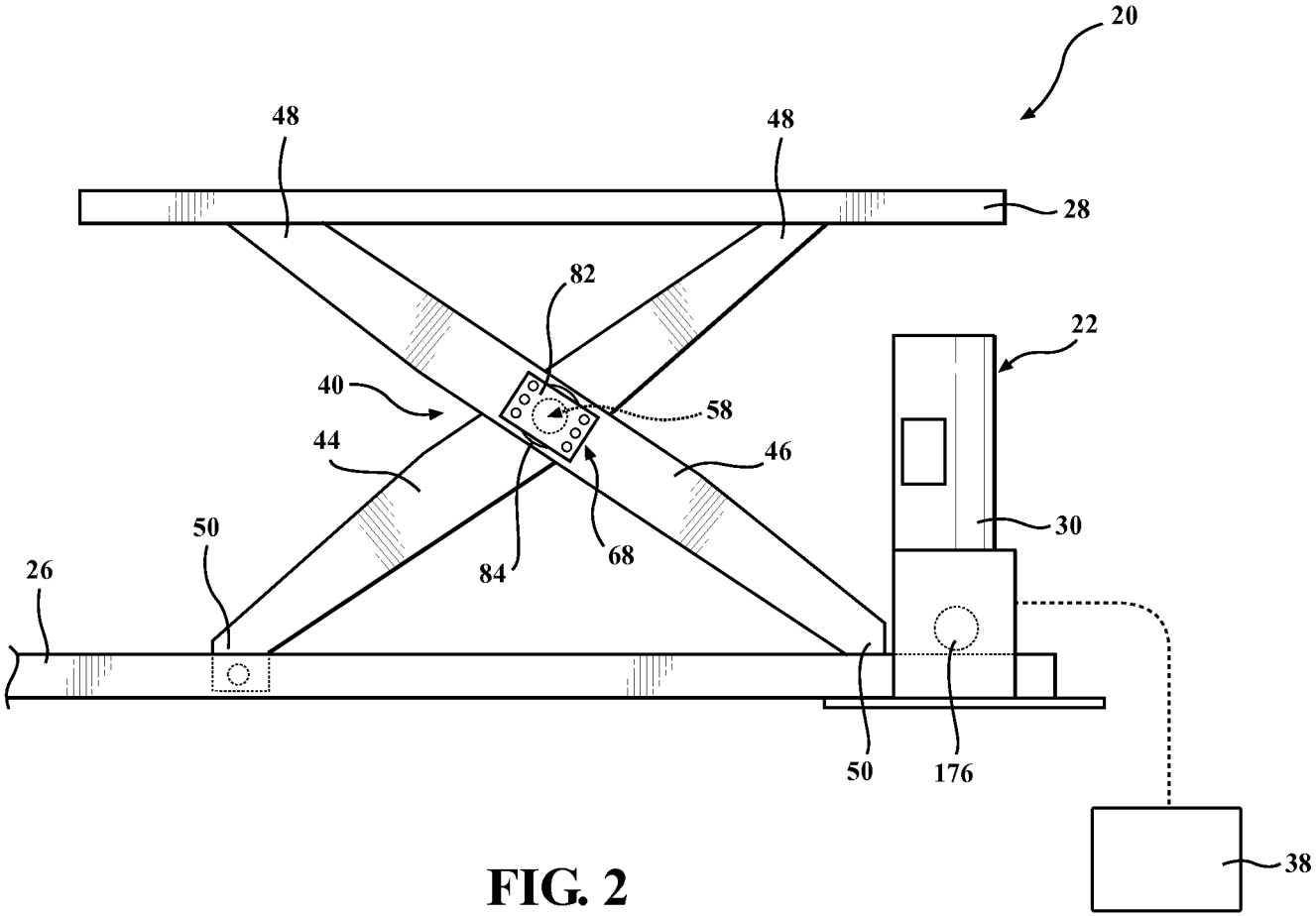
FIG. 2 is a fragmented side view of the first scissor-type lift assembly of the lift system shown in the elevated state.

The first scissor-type lift assembly 22 includes a first base 26 and a first platform 28 coupled to the first base 26 for movement between elevated and lowered states in which the first platform 28 and the first base 26 are distant and proximate, respectively. The first scissor-type lift assembly 22 includes a first motor 30 mounted to the first base 26 to move the first platform 28 between the elevated and lowered states. The first scissor-type lift assembly 22 is shown in the elevated stated in FIGS. 1 and 2.

The second scissor-type lift assembly 24 includes a second base 32 and a second platform 34 coupled to the second base 32 for movement between elevated and lowered states in which the second platform 34 and the second base 32 are distant and proximate, respectively. The second scissor-type lift assembly 24 includes a second motor 36 mounted to the second base 32 to move the second platform 34 between the elevated and lowered states.

As shown schematically in FIG. 1, the lift system 20 includes a controller 38 in communication with the first and second motors 30, 36 to synchronize operation of the first and second motors 30, 36 for moving the first and second platforms 28, 34 between the associated elevated and lowered states in synchronization. The controller 38 has encoders (not shown) which sense and maintain the synchronization of the first and second motors 30, 36. It is to be appreciated that the controller may have a wired connection to the first and second motors 30, 36 or may have a wireless connection to the first and second motors 30, 36. It is to be appreciated that the lift system 20 may use the controller 38 with any suitable number of platforms or motors. It is to be appreciated that the encoders may be any suitable type of electronic control component such as a sensor.

Figure 3:
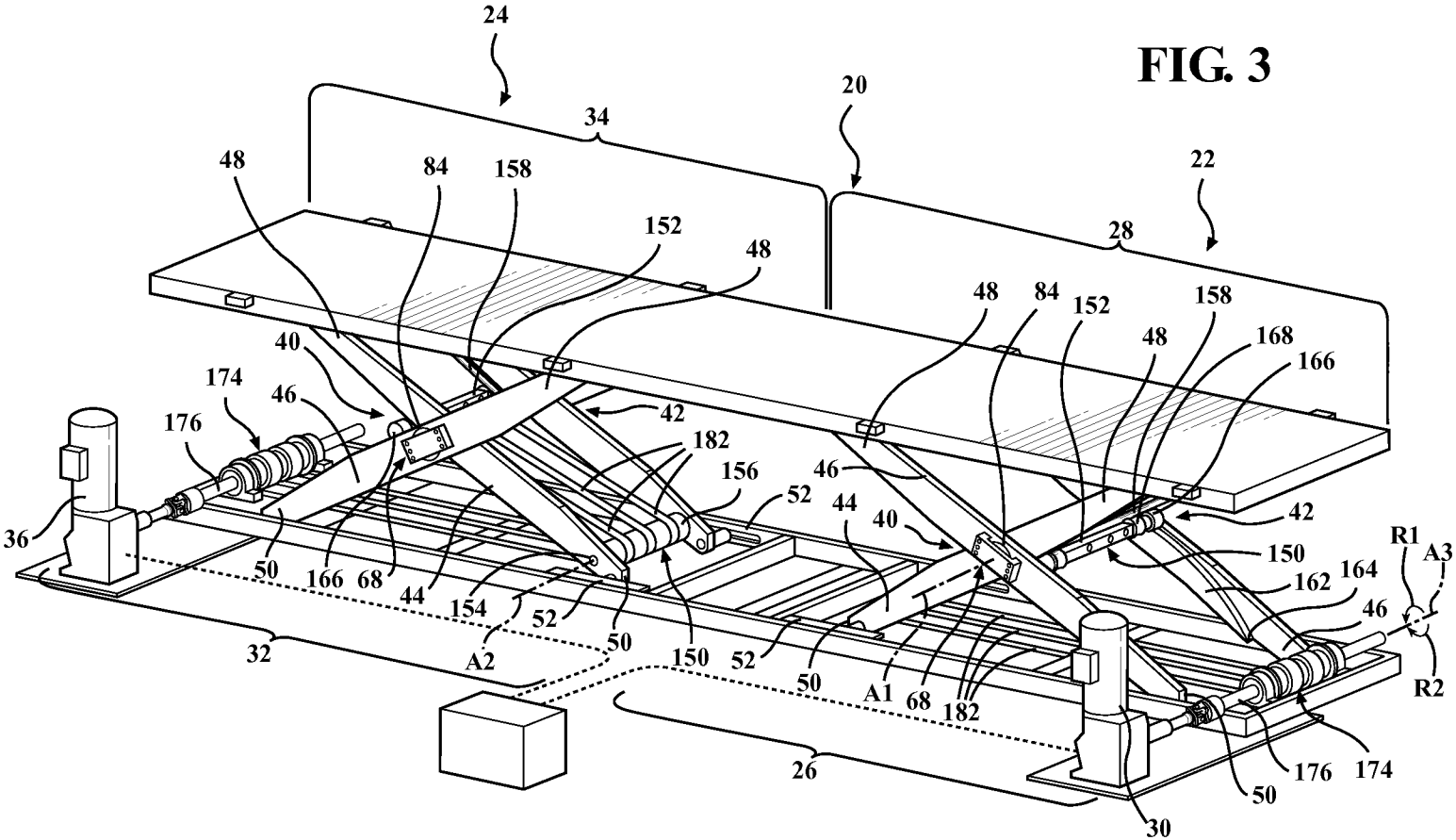
FIG. 3 is a perspective view of an alternative lift system having an interconnected platform with the lift system shown in the elevated state.

As shown in FIGS. 1 and 3, the first and second bases 26, 32 are interconnected for synchronized movement of the first and second bases 26, 32. Specifically, the first and second bases 26, 32 are integral with each other. It should be appreciated that the first and second base 26, 32 may be separate components of the lift system 20 coupled to each other or separate components spaced from each other. Referring to FIG. 3, the first and second platforms 28, 34 can be interconnected for synchronized movement of the first and second platforms 28, 34. It should be appreciated that the first and second platforms 28, 34 may be separate components of the lift system 20 coupled to each other.

The following disclosure describes components and features of the first scissor-type lift assembly 22 of the lift system 20. It should be appreciated that the second scissor-type lift assembly 24 includes corresponding components and features as the first scissor-type lift assembly 22 and operates in substantially the same fashion as the first scissor-type lift assembly 22. The same numbers assigned to the components or features of the first scissor-type lift assembly 22 are used to identify equivalent components and features of the second scissor-type lift assembly 24 in the figures with the exception of components and features of the second scissor-type lift assembly 24 previously numbered.

The first base 26 and the first platform 28, each of which may be metal, are distant as the first platform 28 is in the elevated state. The first base 26 and the first platform 28 are proximate as the first platform 28 is in the lowered state. It is to be appreciated that the first platform 28 can be moved to states between the elevated and lowered states. It is to be appreciated that the first base 26 and the first platform 28 may be any suitable alternative material such as wood or plastic.

The first scissor-type lift assembly 22 includes a first and second pair of scissor arms 40, 42, each of which may be made of steel. The first pair of scissor arms 40 are spaced from the second pair of scissor arms 42 and are transverse to the first base 26 and the first platform 28. The first and second pair of scissor arms 40, 42 each include a first arm 44 and a second arm 46 spaced from the first arm 44 along the first pivot axis A1. It is to be appreciated that the first and second pair of scissor arms 40, 42 may be any suitable alternative metal such as iron or any suitable alternative material such as wood or plastic.

The first and second pair of scissor arms 40, 42 each have upper and lower ends 48, 50 respectively coupled to each of the first platform 28 and the first base 26. The upper ends 48 of the first and second pair of scissor arms 40, 42 are coupled to the first platform 28. The lower ends 50 of the first and second pair of scissor arms 40, 42 are coupled to the first base 26.

The first base 26 has a pair of first tracks 52 with the lower ends 50 of the first arms 44 movably disposed in the pair of first tracks 52. The pair of first tracks 52 guide the lower ends 50 of the first arms 44 to move along the first base 26 as the first platform 28 moves between the elevated and lowered states. The first platform 28 has a pair of second tracks (not shown) with the upper ends 48 of the second arms 46 movably disposed in the pair of second tracks. The pair of second tracks guide the upper ends 48 of the second arms 46 to move along the first platform 28 as the first platform 28 moves between the elevated and lowered states.

The first and second pair of scissor arms 40, 42 are connected to each other intermediate their respective upper and lower ends 48, 50 about a first pivot axis A1 for pivoting relative to each other during the movement of the first platform 28 between the elevated and lowered states. The first pivot axis A1 is transverse to the first pair of scissor arms 40 and moves as the first platform 28 moves between the elevated and lowered states. As shown FIGS. 4-6, the first pair of scissor arms 40 define a first pair of holes 54 aligned with each other along the first pivot axis A1. As shown FIGS. 7 and 8, the second pair of scissor arms 42 define a second pair of holes 56 aligned with each other along the first pivot axis A1.

Figure 5:
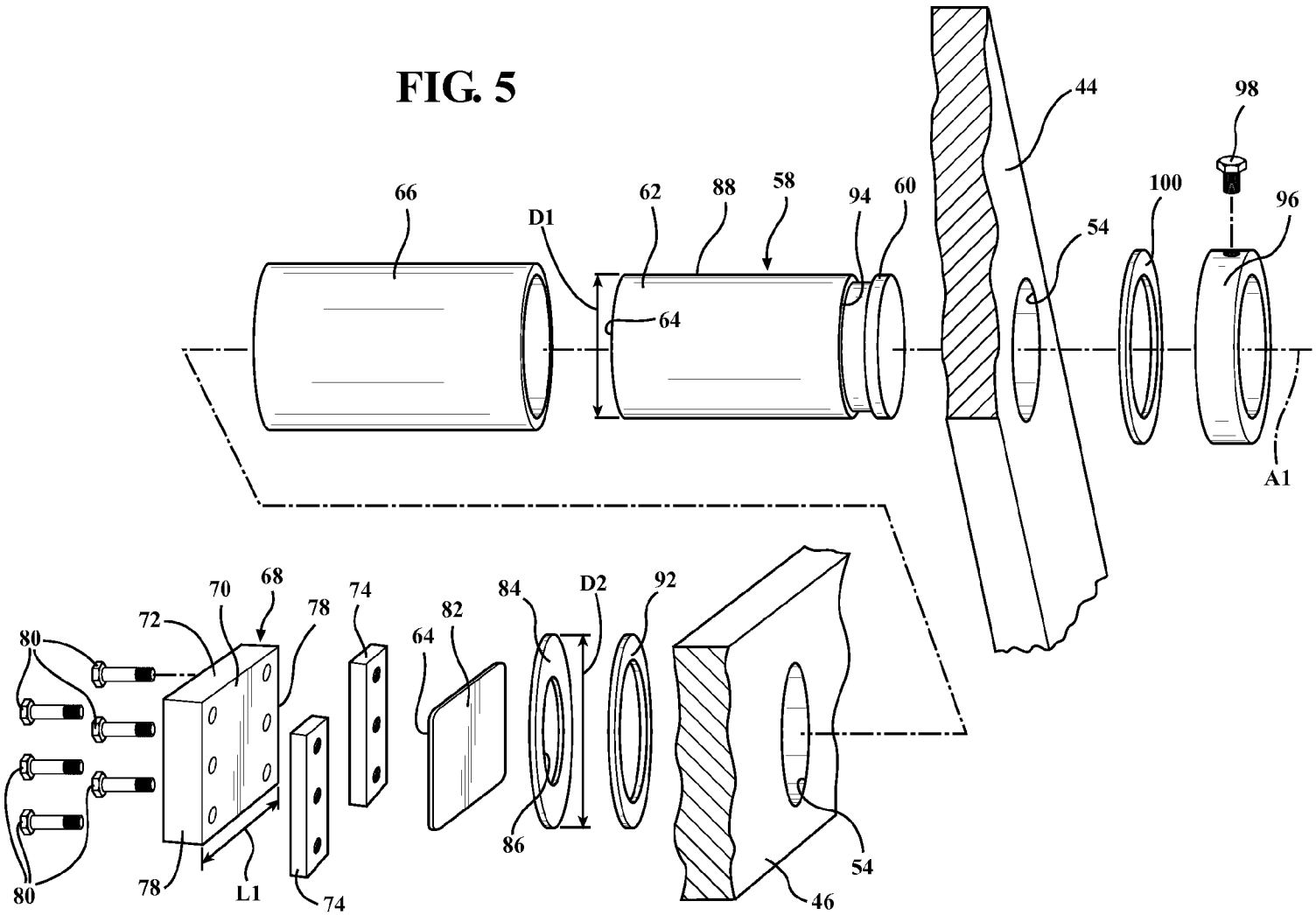
FIG. 5 is an exploded perspective view of the first brace, the first pair of scissor arms, a first shaft, and a first retention device.
Figure 6:
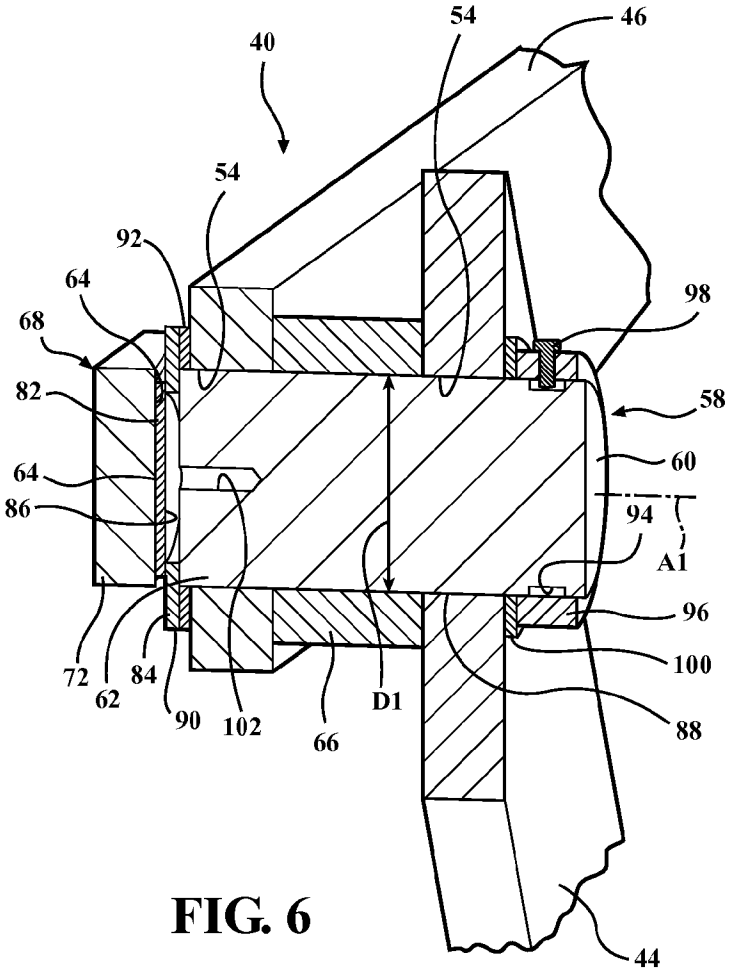
FIG. 6 is a fragmented cross-sectional perspective view of the first brace, the first pair of scissor arms, the first shaft, and the first retention device.

As shown in FIGS. 5 and 6, the first scissor-type lift assembly 22 includes a first shaft 58 disposed along the first pivot axis A1. The first shaft 58 has a cylindrical configuration and a first shaft diameter D1. The first shaft 58 is disposed in the first pair of holes 54 of the first pair of scissor arms 40 aligned with and along the first pivot axis A1. The first pair of scissor arms 40 are pivotably disposed about the first shaft 58. It is to be appreciated that the first shaft 58 may be any alternative configuration such as a tubular configuration.

The first shaft 58 has a first end 60 and a second end 62 spaced from the first end 60 along the first pivot axis A1. The first and second ends 60, 62 extend from the first pair of scissor arms 40 with the second end 62 terminating at a first shaft face 64. The first end 60 extends from the first arm 44 of the first pair of scissor arms 40 toward the second pair of scissor arms 42. The second end 62 extends from the second arm 46 of the first pair of scissor arms 40 away from the second pair of scissor arms 42. The first shaft face 64 is transverse to the first pivot axis A1.

The first scissor-type lift assembly 22 includes a first spacer 66 disposed about the first shaft 58 between the first pair of scissor arms 40 to space the first pair of scissor arms 40 from each other along the first pivot axis A1. The first spacer 66 has a tubular configuration and may be made of plastic. The first spacer 66 prevents the first arms 44 and the second arms 46 from interfering with each other as the first pair of scissor arms 40 pivot about the first pivot axis A1. It is to be appreciated that the first spacer 66 may be fixed to the first shaft 58 or rotatably disposed about the first shaft 58. It is to be appreciated that the first shaft 58 may be any suitable alternative configuration such as a rectangular cuboid configuration with a void defined along the first pivot axis A1. It is to be appreciated that the first spacer 66 may be any suitable alternative material with friction reducing properties such as a lubricated metal.

Figure 4:
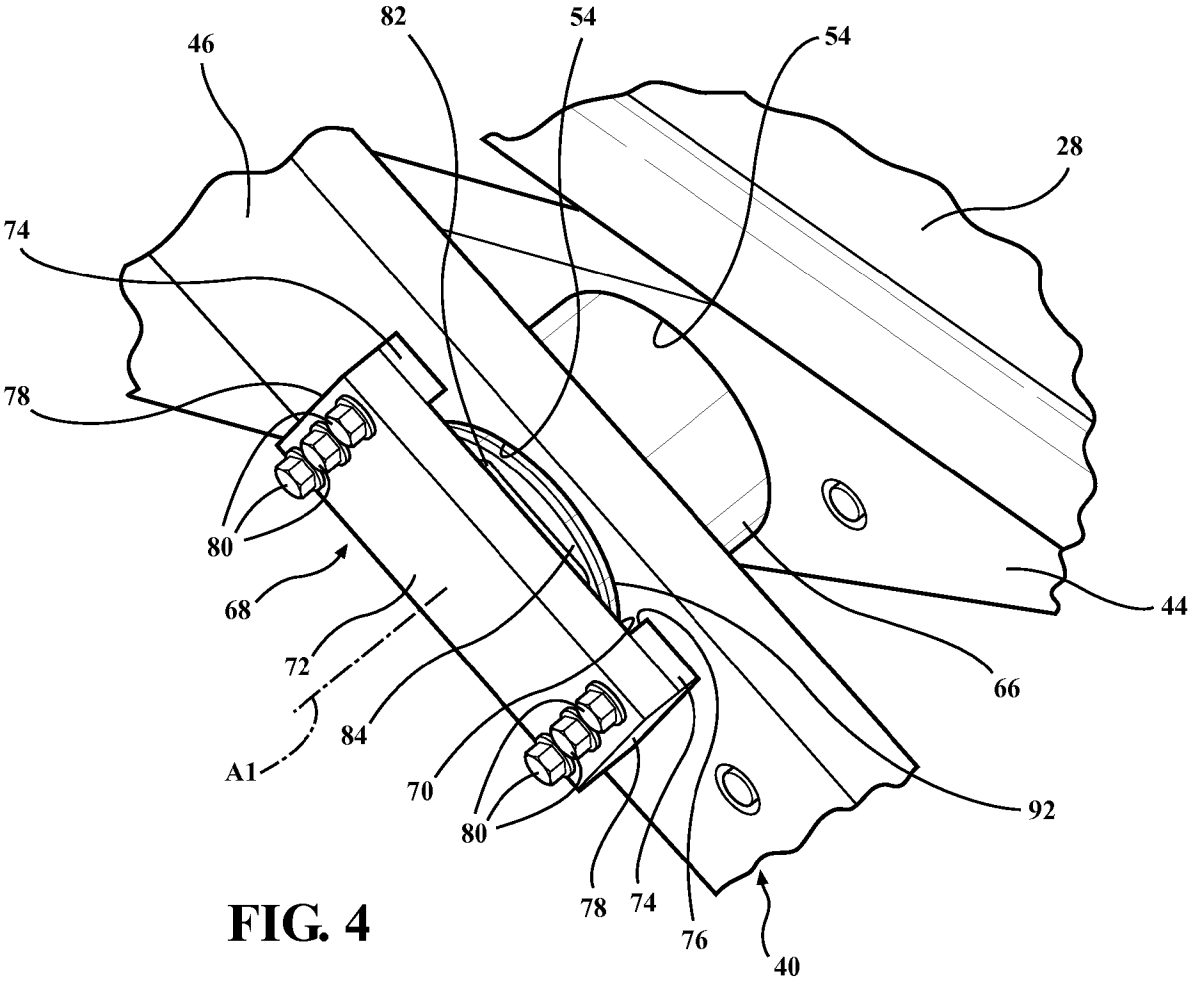
FIG. 4 is a fragmented perspective view of a first brace coupled to a first pair of scissor arms at a first pivot axis.

As shown in FIGS. 4-6, the scissor-type lift assembly includes a first brace 68 fixed to another one of the first pair of scissor arms 40. In the illustrated embodiment, the first brace 68 has a rectangular cuboid configuration and is fixed to the second arm 46 of the first pair of scissor arms 40 transverse to the first pivot axis A1. The first brace 68 has a first brace face 70 facing the second arm 46. Referring to FIG. 5, the first brace 68 has a first length L1 greater than the first shaft diameter D1 of the first shaft 58. It is to be appreciated that the first brace 68 may have any suitable alternative configuration such as a cylindrical configuration with a diameter greater than the first shaft diameter D1 of the first shaft 58.

The first brace 68 abuts the first shaft face 64 of the first shaft 58 to maintain alignment of the first shaft 58 along the first pivot axis A1 for reducing wear between the first pivot axis A1 and the first pair of scissor arms 40. Specifically, the first shaft face 64 is parallel to and abuts the first brace face 70. The first brace face 70 abuts the first shaft face 64 and applies a compressive force to the first shaft 58 to prevent pivoting of the first shaft 58 away from alignment with the first pivot axis A1.

As shown in FIGS. 5 and 6, the first brace 68 has a first central portion 72 and a first support portion 74 extending from the first central portion 72 toward the another one of the first pair of scissor arms 40 to define a first gap 76 between said first central portion 72 and the another of the first pair of scissor arms 40. The first brace face 70 is defined by the first central portion 72 of the first brace 68 with the first gap 76 partially defined by the first brace face 70. The first shaft face 64 is disposed in the first gap 76. Specifically, the second end 62 of the first shaft 58 extends from the second arm 46 of the first pair of scissor arms 40 and is disposed in the first gap 76.

As shown in FIGS. 4 and 5, the first support portion 74 is further defined as a pair of first support portions 74. In the illustrated embodiment, the pair of first support portions 74 have a rectangular cuboid configuration and are disposed between the first brace 68 and the second arm 46 of the first pair of scissor arms 40. The first brace 68 has opposing distal ends 78. The opposing distal ends 78 are spaced from each other and are defined relative to the pair of first support portions 74 of the first brace 68. The pair of first support portions 74 partially define the first gap 76 with the second end 62 of the first shaft 58 disposed between the pair of first support portions 74. It is to be appreciated that the pair of first support portions 74 may be any alternative suitable configuration such as a cylindrical configuration. It is to be appreciated that the pair of first support portions 74 may be integral with the first central portion 72.

One of the pair of first support portions 74 extends from each of the opposing distal ends 78 of the first brace 68. It is appreciated that the pair of first support portions 74 may be mounted to the first brace 68 in any suitable method such as being fixed to the first brace 68, being disposed between the first brace 68 and the second arm 46 of the first pair of scissor arms 40, or being integral with the first brace 68.

The first scissor-type lift assembly 22 includes a first plurality of fasteners 80 extending through the pair of first support portions 74 to secure the first brace 68 to another one of the first pair of scissor arms 40. Specifically, the first plurality of fasteners 80 are disposed in the pair of first support portions 74 and are secured to the second arm 46 of the first pair of scissor arms 40. The first plurality of fasteners 80 are further defined as bolts. It is to be appreciated that the first plurality of fasteners 80 may be any alternative fastener such as a screw.

As shown in FIGS. 4-6, the first scissor-type lift assembly 22 includes a first flange 84 coupled to the first shaft 58 to further define the first shaft face 64 and further maintain alignment of the first shaft 58 along the first pivot axis A1 for reducing wear between the first pivot axis A1 and the first pair of scissor arms 40. As illustrated, the first flange 84 is fixed to the second end 62 of the first shaft 58 and is disposed in the first gap 76 between the pair of first support portions 74. The first flange 84 may be separately mounted to the first scissor-type lift assembly 22 (as shown) or the first flange 84 may be integral with the first shaft 58.

Referring to FIGS. 5 and 6, the first flange 84 has a substantially flat washer like configuration defining a first cavity 86 about the first pivot axis A1. It is to be appreciated that the first flange 84 may be any suitable alternative configuration such as a solid cylindrical configuration.

The first shaft 58 has a first shaft periphery 88 with a circular configuration. The first flange 84 has a first flange periphery 90. Specifically referring to FIG. 5, the first flange 84 has a first flange diameter D2 and the first flange periphery 90 has a circular configuration. The first flange periphery 90 is disposed radially further from the first pivot axis A1 than the first shaft periphery 88 to further maintain alignment of the first shaft 58 along the first pivot axis A1 for reducing wear between the first pivot axis A1 and the first pair of scissor arms 40. Specifically, the first flange diameter D2 is greater than the first shaft diameter D1 of the first shaft 58 with the first flange 84 extending further from the first pivot axis A1 than the first shaft 58 to engage the second arm 46 of the first pair of scissor arms 40 and the first brace 68 to prevent the first shaft 58 from moving along the first pivot axis A1 toward the second pair of scissor arms 42. The first flange 84 prevents tilting or rocking of the first shaft 58 out of alignment with the first pivot axis A1. Said differently, the first flange 84 prevents the first shaft 58 from wobbling in the first pair of holes 54 of the first pair of scissor arms 40. It is to be appreciated that the first flange 84 may directly abut the another one of the first pair of scissor arms 40.

As shown in FIGS. 5-6, the first scissor-type lift assembly 22 includes a first bushing 92. The first bushing 92 has an annular configuration and may be made of as plastic. The first bushing 92 is disposed between the first flange 84 and the another one of the first pair of scissor arms 40 to reduce friction between the first flange 84 and the another one of the first pair of scissor arms 40 as the first pair of scissor arms 40 pivots about the first pivot axis A1. The first flange 84 and the first bushing 92 engage the second arm 46 of the first pair of scissor arms 40 and first brace 68 to prevent the first shaft 58 from pivoting away from alignment with the first pivot axis A1. The first bushing 92 also reduces friction between the first flange 84 and the second arm 46 of the first pair of scissor arms 40 as the first pair of scissor arms 40 pivot about the first pivot axis A1. Specifically, the first bushing 92 is disposed about the first shaft 58 between the first flange 84 and the second arm 46 of the first pair of scissor arms 40. As the first pair of scissor arms 40 pivot, the first flange 84 and first bushing 92 abuts the second arm 46 and prevents pivoting of the first shaft 58. It is to be appreciated that the first bushing 92 may be of any suitable alternative materials with friction reducing properties such as a lubricated metal. It is to be appreciated that the first bushing 92 may be of any suitable alternative configuration such as a rectangular cuboid.

The first scissor-type lift assembly 22 can also include a first plate or shim 82 coupled to the first shaft 58 to further define the first shaft face 64 and to further maintain alignment of the first shaft 58 along the first pivot axis A1 for reducing wear between the first pivot axis A1 and the first pair of scissor arms 40. Specifically, the first plate 82 is disposed in the first gap 76 between the first flange 84 and the first brace 68. The first plate 82 is also disposed in the first gap 76 between the first shaft 58 or the first flange 84 and the first brace 68 to ensure contact between the first shaft 58 or first flange 84 and the first brace 68. It is to be appreciated that the first scissor-type lift assembly 22 may include the first plate 82 and the first flange 84 with the first plate 82 defining the first shaft face 64 and the first flange 84 disposed between the second end 62 of the first shaft 58 and the first plate 82.

The first shaft 58 defines a first groove 94 about the first end 60. The first groove 94 is defined in the first shaft 58 about the first pivot axis A1. The first scissor-type lift assembly 22 includes a first retention device 96 coupled to the first end 60 of the first shaft 58. The first retention device 96 has tubular configuration and is disposed about the first end 60. Specifically, the first retention device 96 disposed about the first shaft 58 and aligned with the first groove 94. It is to be appreciated that the first retention device 96 may be any suitable alternative configuration such as a cylindrical configuration.

The first scissor-type lift assembly 22 includes a first retention fastener 98 extending through the first retention device 96 and disposed in the first groove 94 of the first shaft 58 to secure the first retention device 96 to the first shaft 58. Specifically, the first retention fastener 98 is further defined as a bolt. The first retention fastener 98 prevents the first retention device 96 from moving along the first shaft 58 away from the first arm 44 of the first pair of scissor arms 40. The first retention device 96 prevents the first shaft 58 from moving along the first pivot axis A1 away from the second pair of scissor arms 42. It is to be appreciated that the first retention fastener 98 may be any suitable alternative fastener such as a screw.

The first scissor-type lift assembly 22 includes a first retention bushing 100. The first retention bushing 100 has a tubular configuration and may be made of as plastic. The first retention bushing 100 is disposed between the first retention device 96 and the first arm 44 of the first pair of scissor arms 40 with the first shaft 58 reducing friction between the first retention device 96 and the first arm 44 of the first pair of scissor arms 40 as the first pair of scissor arms 40 pivot about the first pivot axis A1. It is to be appreciated that the first retention bushing 100 may be of any suitable alternative materials with friction reducing properties such as a lubricated metal. It is to be appreciated that the first retention bushing 100 may be of any suitable alternative configuration such as a rectangular cuboid.

The first shaft 58 has a first removal feature 102 defined in the second end 62 for removing the first shaft 58 from the first pair of scissor arms 40. Specifically, the first shaft 58 defines the first removal feature 102 as a threaded void extending through the first shaft face 64. The first removal feature 102 is defined in the first cavity 86 of the first flange 84. An operator may insert a threaded rod (not shown) into the first removal feature 102 and use a removal tool (not shown) to pull the first shaft 58 along the first pivot axis A1 and remove the first shaft 58 from the first pair of scissor arms 40.

Figure 7:
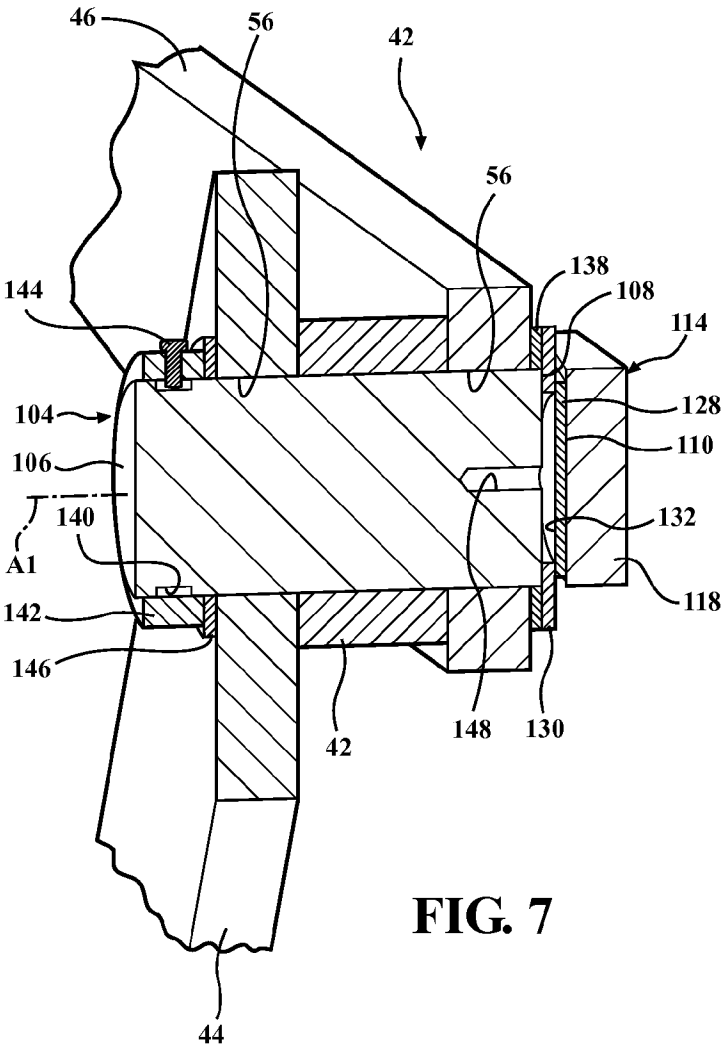
FIG. 7 is a fragmented cross-sectional perspective view of a second brace, a second pair of scissor arms, a second shaft, and a second retention device.
Figure 8:
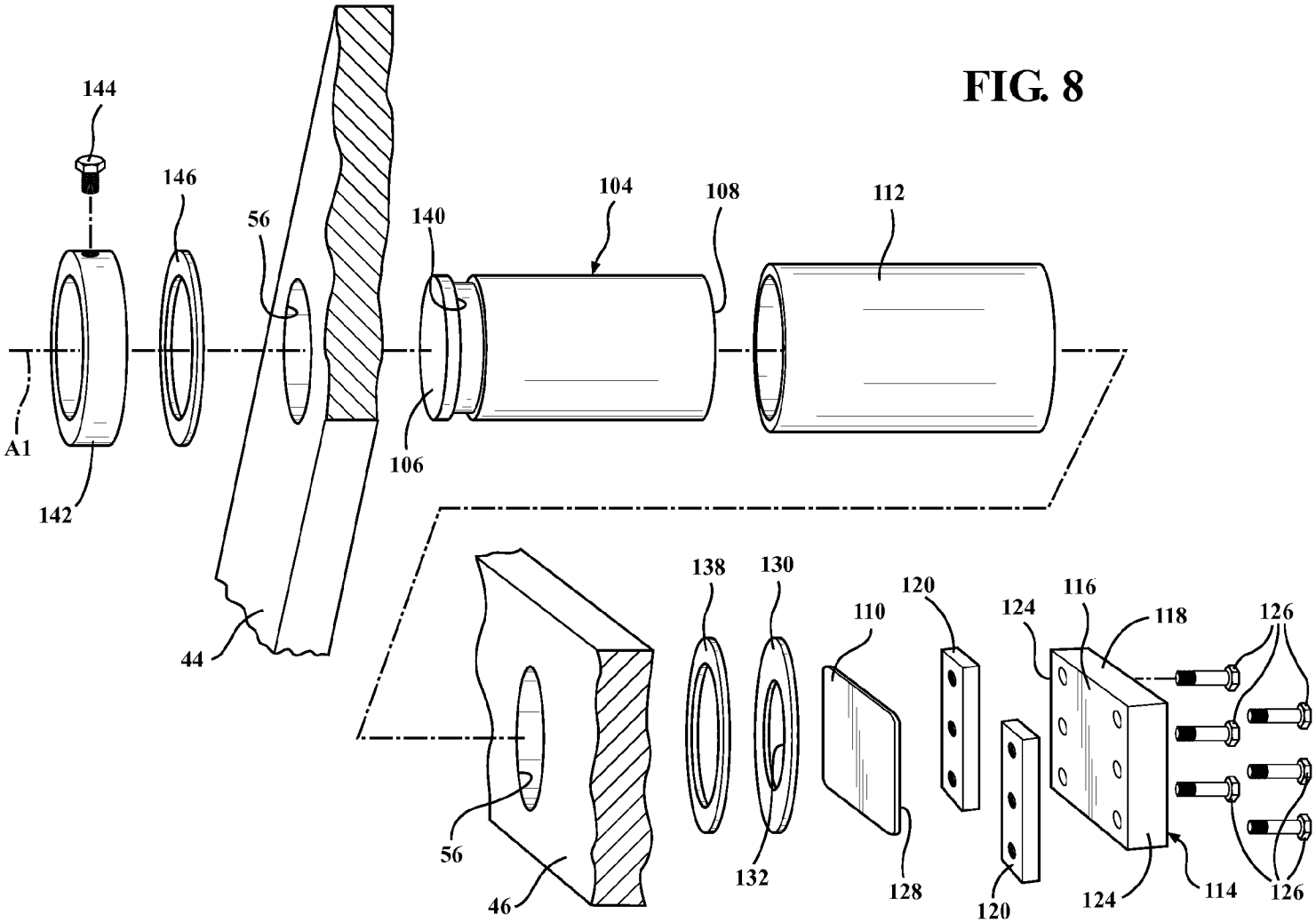
FIG. 8 is an exploded perspective view of the second brace, the second pair of scissor arms, the second shaft, and the second retention device.
Figure 9:
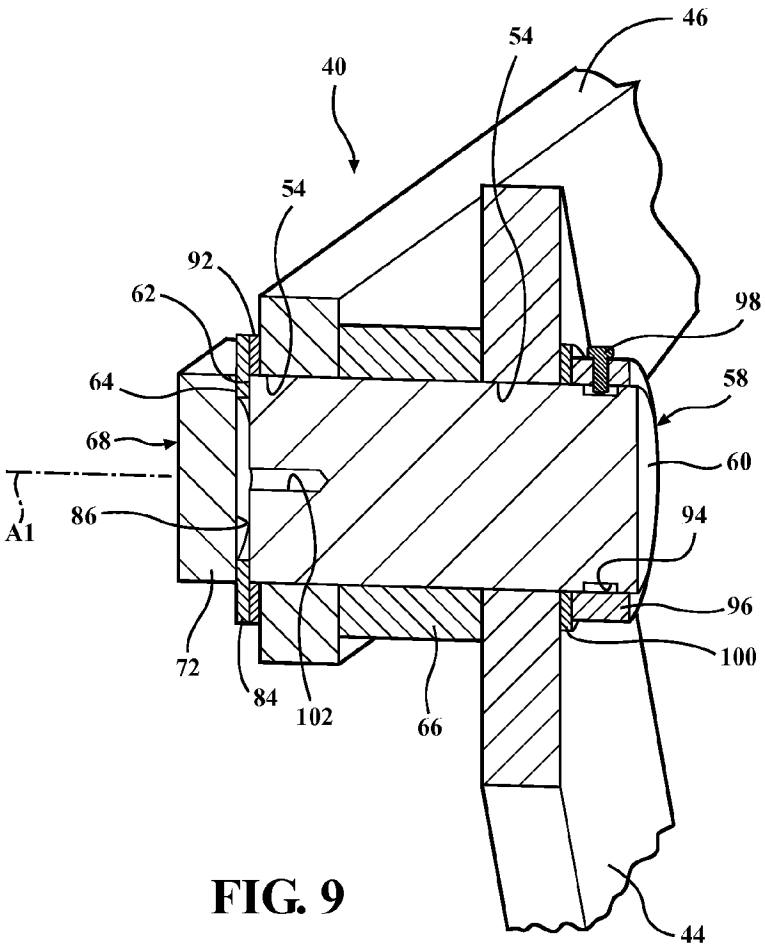
FIG. 9 is a fragmented cross-sectional perspective view of an alternative arrangement of the first brace, the first pair of scissor arms, and the first shaft.

As shown in FIGS. 7 and 8, the second scissor-type lift assembly 24 includes a second shaft 104 disposed along the first pivot axis A1. The second shaft 104 has a second shaft diameter D3. The second shaft 104 is disposed in the second pair of holes 56 of the second pair of scissor arms 42 aligned with and along the first pivot axis A1. The second pair of scissor arms 42 are pivotably disposed about the second shaft 104.

The second shaft 104 has a third end 106 and a fourth end 108 spaced from the third end 106 along the first pivot axis A1. The third and fourth ends 106, 108 extend from the second pair of scissor arms 42 with the fourth end 108 terminating at a second shaft face 110. The third end 106 extends from the first arm 44 of the second pair of scissor arms 42 toward the first pair of scissor arms 40. The fourth end 108 extends from second arm 46 of the second pair of scissor arms 42 away from the first pair of scissor arms 40.

The second scissor-type lift assembly 24 includes a second spacer 112 disposed about the second shaft 104 between the second pair of scissor arms 42 to space the second pair of scissor arms 42 from each other along the first pivot axis A1. The second spacer 112 prevents the first arms 44 and the second arms 46 from interfering with each other as the second pair of scissor arms 42 pivot about the first pivot axis A1. It is to be appreciated that the second spacer 112 may be fixed to the second shaft 104 or rotatably disposed about the second shaft 104.

The scissor-type lift assembly includes a second brace 114 fixed to another one of the second pair of scissor arms 42. In the illustrated embodiment, the second brace 114 has a second brace face 116 with a second length L2 greater than the second shaft diameter D3 of the second shaft 104. The second brace 114 abuts the second shaft face 110 of the second shaft 104 to maintain alignment of the second shaft 104 along the first pivot axis A1 for reducing wear between the first pivot axis A1 and the second pair of scissor arms 42. The second brace face 114 abuts the second shaft face 110 and applies a compressive force to the second shaft 104 to prevent pivoting of the second shaft 104 away from alignment with the first pivot axis A1.

The second brace 114 has a second central portion 118 and a second support portion 120 extending from the second central portion 118 toward the another one of the second pair of scissor arms 42 to define a second gap 122 between said second central portion 118 and the another of the second pair of scissor arms 42. The second brace face 116 is defined by the second central portion 118 of the second brace 114 and the second gap 122 is partially defined by the second brace face 116. The second shaft face 110 is disposed in the second gap 122. Specifically, the fourth end 108 of the second shaft 104 extends from the second arm 46 of the second pair of scissor arms 42 and is disposed in the second gap 122.

The second support portion 120 is further defined as a pair of second support portions 120. The second brace 114 has opposing distal ends 124. The opposing distal ends 124 are spaced from each other and are defined in the pair of second support portions 120 of the second brace 114. The pair of second support portions 120 are disposed between the second brace 114 and another one of the second pair of scissor arms 42. The second brace 114 has a opposing distal ends 124.

One of the pair of second support portions 120 extends from each opposing distal ends 124 of the second brace 114. The second scissor-type lift assembly 24 includes a second plurality of fasteners 126 extending through the pair of second support portions 120 to secure the second brace 114 to another one of the second pair of scissor arms 42. Specifically, the second plurality of fasteners 126 are disposed in the pair of second support portions 120 and are secured to the second arm 46 of the second pair of scissor arms 42.

The second scissor-type lift assembly 24 includes a second flange 130 coupled to the second shaft 104 to further define the second shaft face 110 and further maintain alignment of the second shaft 104 along the first pivot axis A1 for reducing wear between the first pivot axis A1 and the second pair of scissor arms 42. As illustrated, the second flange 130 is fixed to the second end 109 of the second shaft 104 and is disposed in the second gap 122 between the pair of second support portions 120. The second flange 130 may be separately mounted to the second scissor-type lift assembly 24 (as shown) or the second flange 130 may be integral with the second shaft 104. The second flange 130 defines a second cavity 132 about the first pivot axis A1.

The second shaft 104 has a second shaft periphery 136. The second flange 130 has a second flange periphery 136. The second flange 130 has a second flange diameter D3 and the second flange periphery 136 has a circular configuration. The second flange periphery 136 is disposed radially further from the first pivot axis A1 than the second shaft periphery 136 to further maintain alignment of the second shaft 104 along the first pivot axis A1 for reducing wear between the first pivot axis A1 and the second pair of scissor arms 42. Specifically, the second flange diameter D3 is greater than the second shaft diameter D2 of the second flange 130 with the second flange 130 extending further from the first pivot axis A1 than the second shaft 104 to engage both the second arm 46 of the second pair of scissor arms 42 and the second brace 114 to prevent the second shaft 104 from moving along the first pivot axis A1 toward the first pair of scissor arms 40. The second flange 130 prevents tilting or rocking of the second shaft 104 out of alignment with the first pivot axis A1. Said differently, the second flange 130 prevents the second shaft 130 from wobbling in the second pair of holes 56 of the second pair of scissor arms 42. It is to be appreciated that the second flange 130 may directly abut the another one of the second pair of scissor arms 42.

The second scissor-type lift assembly 24 includes a second bushing 138. The second bushing 138 is disposed between the second flange 130 and the another one of the second pair of scissor arms 42 to reduce friction between the second flange 130 and the another one of the second pair of scissor arms 42 as the second pair of scissor arms 42 pivots about the first pivot axis A1. The second bushing 138 disposed about the fourth end 108 of the second shaft 104. The second bushing 138 abuts the second arm 46 of the second pair of scissor arms 42 and the second flange 130. Specifically, the second bushing 138 is disposed about the second shaft 104 between the second flange 130 and the second arm 46 of the second pair of scissor arms 42. As the second pair of scissor arms 42 pivot, the second flange 130 and the second bushing 138 abut the second arm 46 and prevent pivoting of the second shaft 104.

The second scissor-type lift assembly 24 includes a second plate or shim 128 coupled to the second shaft 104 to further define the second shaft face 110 and to further maintain alignment of the second shaft 104 along the first pivot axis A1 for reducing wear between the first pivot axis A1 and the second pair of scissor arms 42. Specifically, the second plate 128 is disposed in the second gap 122 between the second flange 130 and the second brace 114. The second plate 128 is disposed in the second gap 122 between the second shaft 104 or the second flange 130 and the second brace 114 to ensure contact between the second shaft 104 or the second flange 130 and the second brace 114. It is to be appreciated that the second scissor-type lift assembly 24 may include the second plate 128 and the second flange 130 with the second plate 128 defining the second shaft face 110 and the second flange 130 disposed between the fourth end 108 of the second shaft 104 and the second plate 128.

The second shaft 104 defines a second groove 140 about the third end 106. The second scissor-type lift assembly 24 includes a second retention device 142 coupled to the third end 106 of the second shaft 104. Specifically, the second retention device 142 disposed about the second shaft 104 and aligned with the second groove 140.

The second scissor-type lift assembly 24 includes a second retention fastener 144 extending through the second retention device 142 and disposed in the second groove 140 of the second shaft 104 to secure the second retention device 142 to the second shaft 104. The second retention device 142 prevents the second shaft 104 from moving along the first pivot axis A1 away from the first pair of scissor arms 40. The second shaft 104 has a second removal feature 148 defined in the fourth end 108 for removing the second shaft 104 from the second pair of scissor arms 42.

As shown in FIGS. 1 and 3, the first scissor-type lift assembly 22 includes a first guide arrangement 150 mounted to the first and second pair of scissor arms 40, 42. Specifically, the first guide arrangement 150 is further defined as a first engagement shaft 152 and a first pulley shaft 154. The first engagement shaft 152 is movably disposed between the second arms 46 of the first and second pair of scissor arms 40, 42. The first pulley shaft 154 is disposed between the lower ends 50 of the first arms 44 of the first and second pair of scissor arms 40, 42. The first pulley shaft 154 defines a first pulley axis A2 and has a first pulley 156 rotatably disposed about the first pulley shaft 154.

Figure 11:
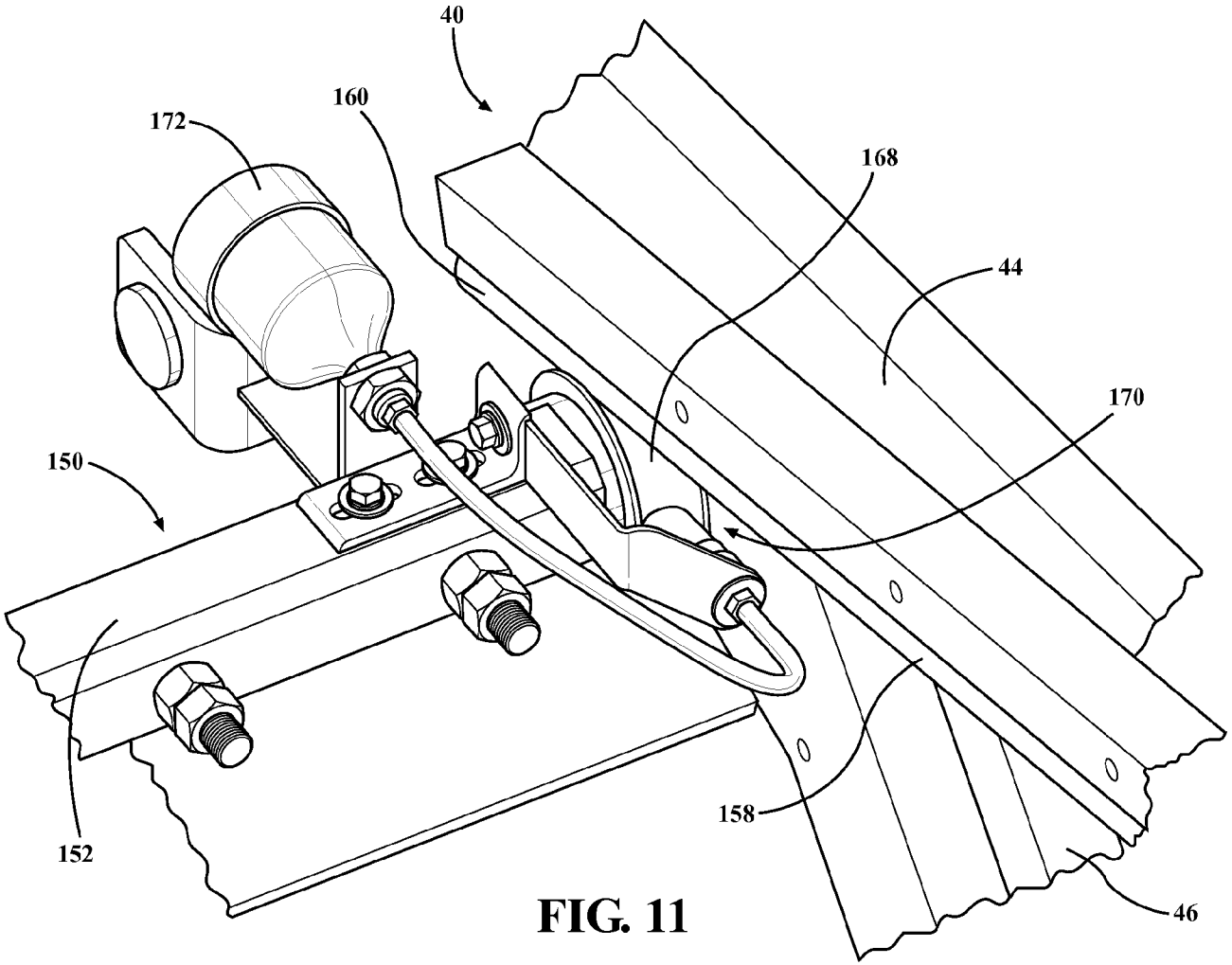
FIG. 11 another fragmented perspective view of the first lubrication feature coupled to the first engagement shaft.
Figure 12:
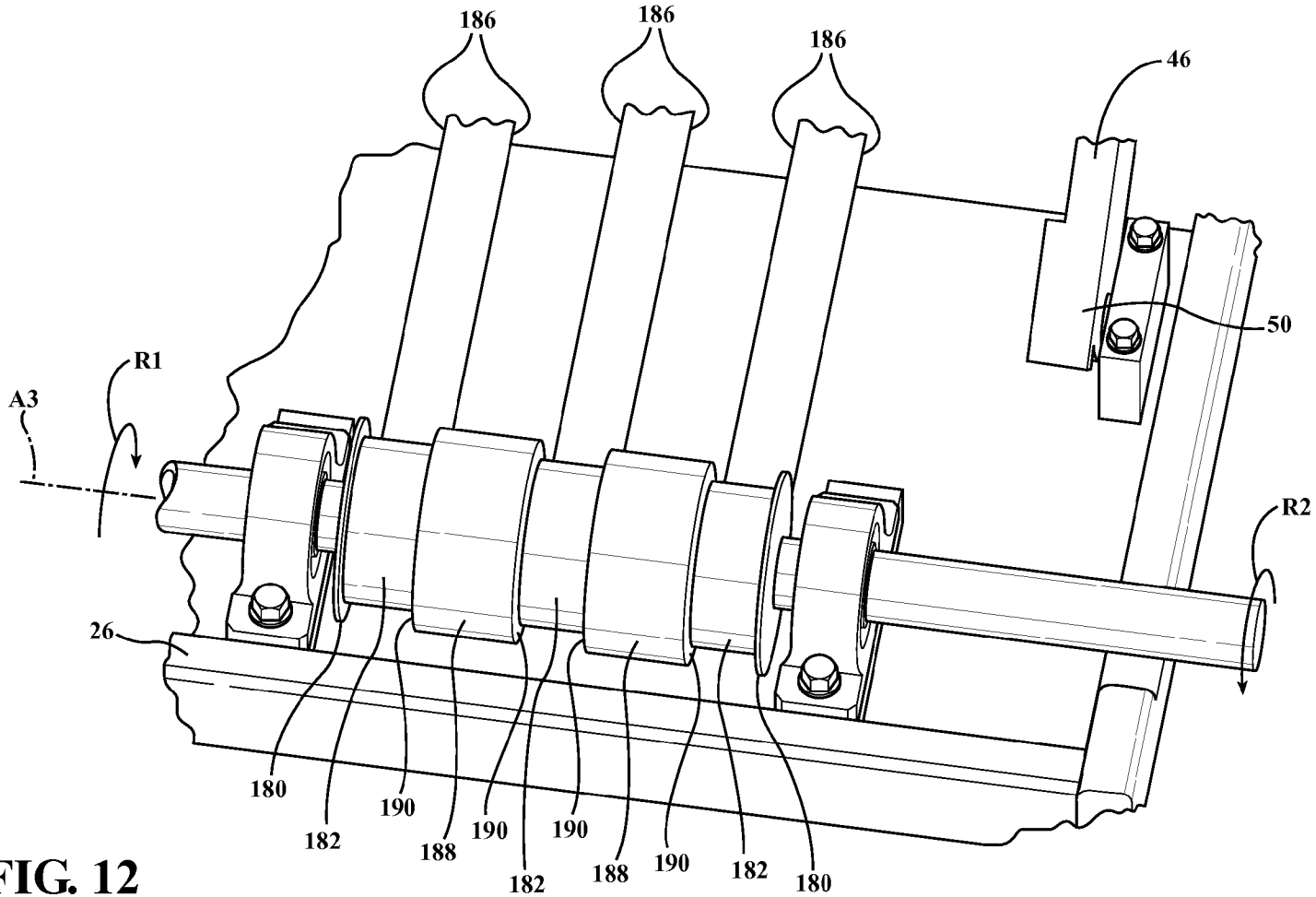
FIG. 12 is a fragmented perspective view of a first spool coupled to a first base and having a plurality of first belts and a plurality of first rollers.
Figure 13:
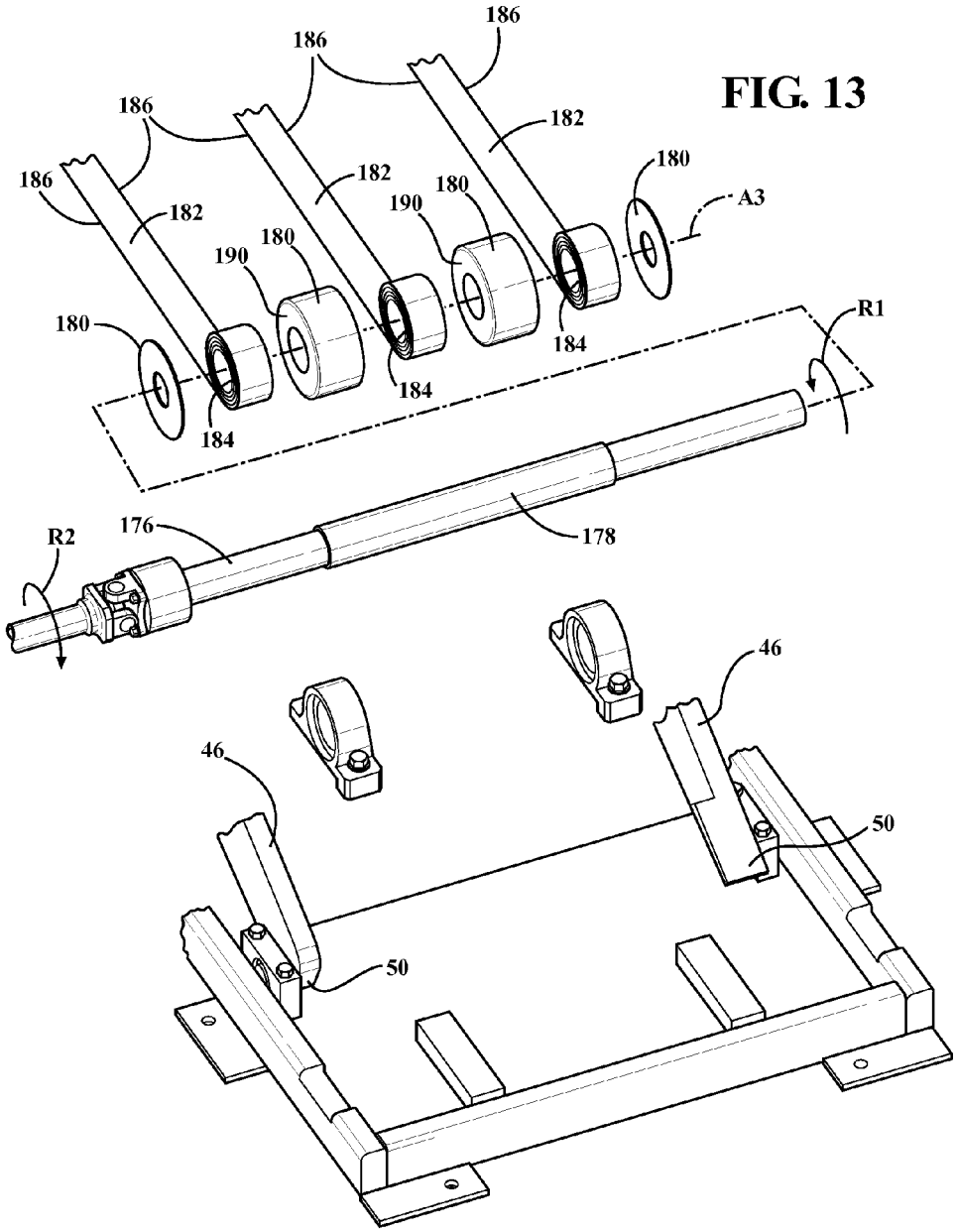
FIG. 13 is an exploded perspective view of the first spool coupled to the first base with the plurality of first belts and the plurality of first rollers.
Figure 14:
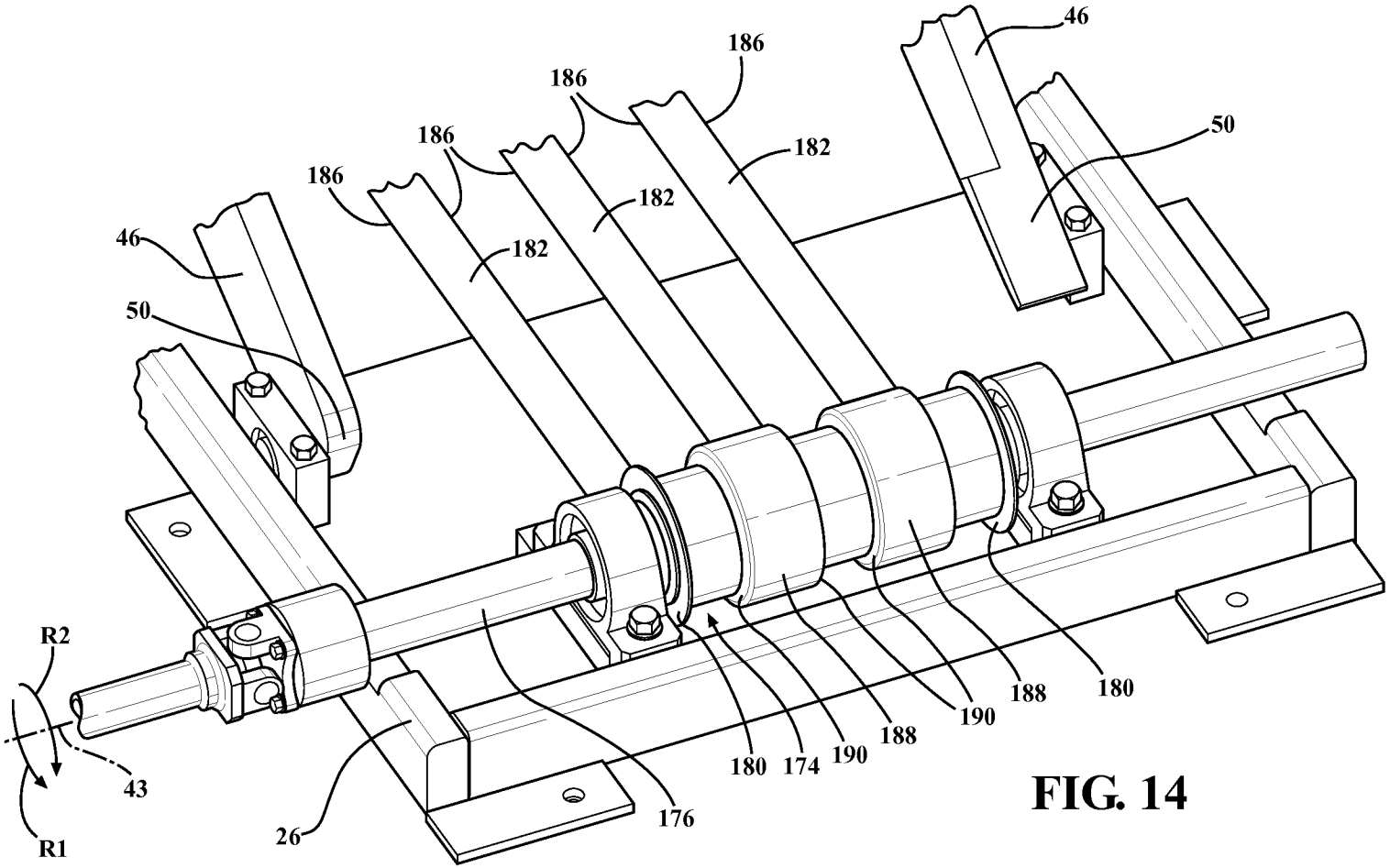
FIG. 14 is another perspective view of the first spool coupled to the first base with the plurality of first belts and the plurality of first rollers.

The first and second pair of scissor arms 40, 42 have a first pair of rods 158 with one of the first pair of rods 158 coupled to one of the first arms 44 and another one of the first pair of rods 158 coupled to another one of the first arms 44. The first pair of rods 158 have a cylindrical configuration and extend along the first arms 44 between the upper ends 48 of the first arms 44 and the first pivot axis A1. As shown in FIG. 11, the first pair of rods 158 have a lowered rod end (not shown) relative to the upper ends 48 of the first arms 44 and an elevated rod end 160 relative the first pivot axis A1. It is to be appreciated that the first pair of rods 158 may be any suitable alternative configuration such as a rectangular cuboid configuration.

As shown in FIGS. 1 and 3, the first and second pair of scissor arms 40, 42 have a first pair of cams 162 with one of the first pair of cams 162 extending from one of the second arms 46 and another one of the first pair of cams 162 extending from another one of the second arms 46. The first pair of cams 162 have an arcuate configuration and extend along the second arms 46 between the lower ends 50 and the first pivot axis A1. The first pair of cams 162 have a lowered cam end 164 relative to the lower ends 50 of the second arms 46 and an elevated rod end 160 (not shown) relative the first pivot axis A1. It is to be appreciated that the first pair of cams 162 may be any suitable alternative configuration such as a flat configuration.

Figure 10:
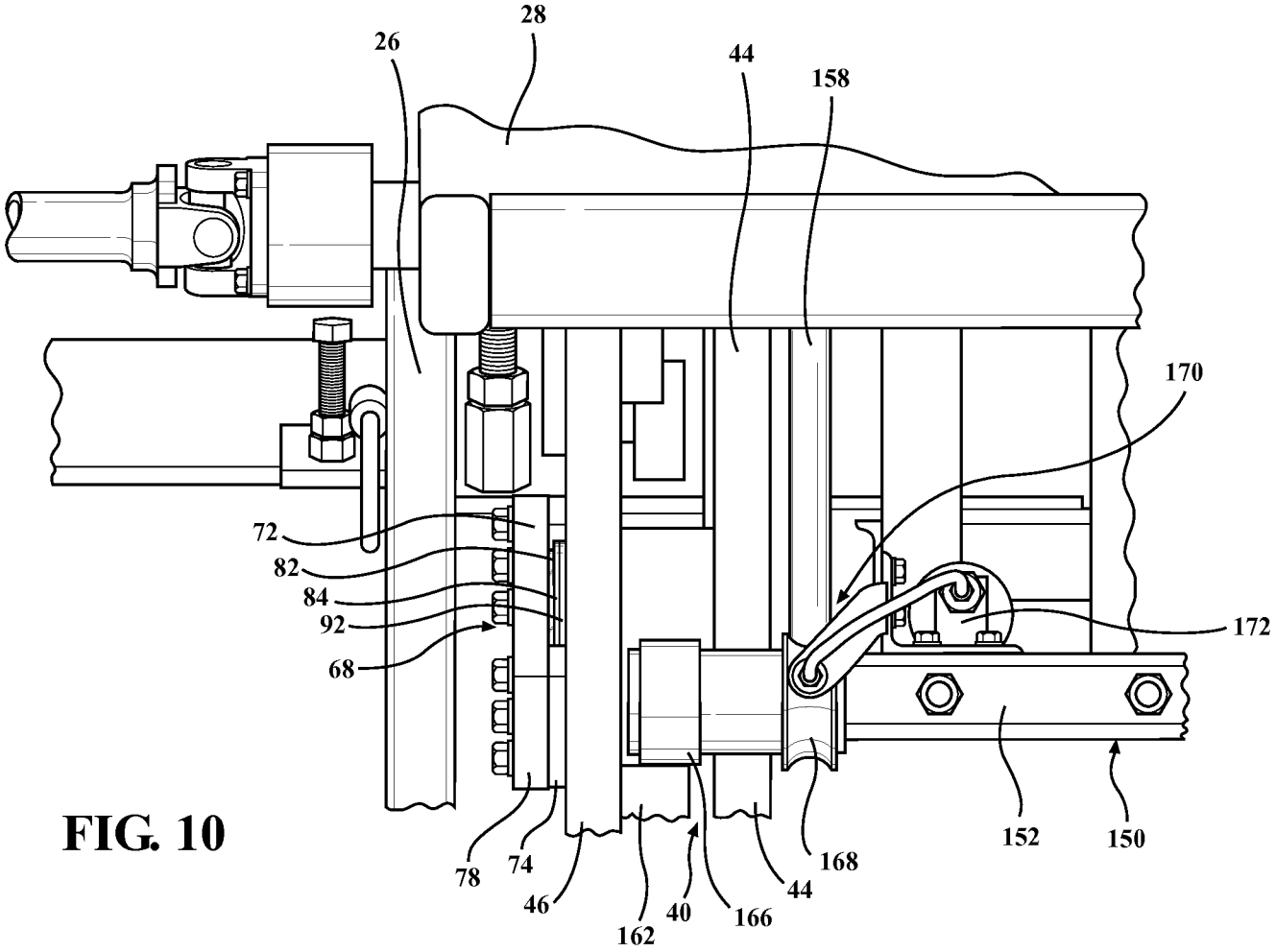
FIG. 10 is a fragmented perspective view of a first lubrication feature coupled to a first engagement shaft.

As shown in FIGS. 1, 3, and 10, the first engagement shaft 152 has a first pair of cam followers 166 with one of the first pair of cam followers 166 rotatably abutting one of the first pair of cams 162 and another one of the first pair of cam followers 166 rotatably abutting the another one of the first pair of cams 162. The first pair of cam followers 166 are disposed along the first pair of cams 162 at the lowered cam ends 164 as the first platform 28 is in the lowered state and the first pair of cam followers 166 are disposed along the first pair of cams 162 at the elevated cam ends as the first platform 28 is in the elevated state. As the first and second pair of scissor arms 40, 42 pivot about the first pivot axis A1, the first pair of cam followers 166 move along the first pair of cams 162 to lower and raise the first platform 28.

As shown in FIGS. 1, 3, and 10-11, the first engagement shaft 152 has a first pair of rod followers 168 with one of the first pair of rod followers 168 rotatably abutting one of the first pair of rods 158 and another one of the first pair of rod followers 168 rotatably abutting another one of the first pair of rods 158. The first pair of rod followers 168 are disposed along the first pair of rods 158 at the lowered rod ends as the first platform 28 is in the lowered state and the first pair of rod followers 168 are disposed along the first pair of rods 158 at the elevated rod ends 160 as the first platform 28 is in the elevated state. As the first and second pair of scissor arms 40, 42 pivot about the first pivot axis A1, the first pair of rod followers 168 move along the first pair of rods 158 to lower and raise the first platform 28.

The first guide arrangement 150 is movable with the first and second pair of scissor arms 40, 42 during movement of the first platform 28. The first engagement shaft 152 moves along the first pair of rods 158 and the first pair of cams 162 as the first and second pair of scissor arms 40, 42 pivot and the first platform 28 moves between the elevated and lowered states. The first pulley shaft 154 moves along the first base 26 as the first and second pair of scissor arms 40, 42 pivot and the first platform 28 moves between the elevated and lowered states.

As shown in FIGS. 10 and 11, the first scissor-type lift assembly 22 includes a first pair of interfaces 170 at which the first engagement shaft 152 engages the first and second pair of scissor arms 40, 42. Specifically, the first pair of interfaces 170 are defined as the first pair of rod followers 168 rotatably abut the first pair of rods 158 of the first arms 44. The first scissor-type lift assembly 22 includes a first pair of lubrication features 172 coupled to the first engagement shaft 152 with the first pair of lubrication features 172 lubricating the first pair of interfaces 170 as the first platform 28 moves between the elevated and lowered states. Specifically, the first pair of lubrication features 172 lubricate the first pair of rod followers 168 as the first pair of rod followers 168 move along the first pair of rods 158.

As shown in FIGS. 1, 3 and 12-14, the first scissor-type lift assembly 22 includes a first spool 174 coupled to the first base 26 and defining a first spool axis A3. The first scissor-type lift assembly 22 has a first spool shaft 176 rotatably mounted to the first base 26 and extending along the first spool axis A3. The first spool shaft 176 is rotatably coupled to the first motor 30. The first spool 174 has a first spool base 178 disposed about the first spool shaft 176 along the first spool axis A3. The first spool 174 and the first spool base 178 rotate about the first spool axis A3 as a unit. The first spool 174 has a first pair of spool flanges 180 spaced from each along the first spool axis A3 and abutting the first spool base 178.

As shown in FIGS. 1 and 3, the first guide arrangement 150 defines a first path. The first path is defined from the first spool 174 along the first base 26 to the first pulley 156 of the first engagement shaft 152. The first path is defined about the first pulley 156 of the first engagement shaft 152 and between the first arms 44 to the first pulley shaft 154. It is to be appreciated that the first path may have any suitable alternative route or configuration depending on the number of pulleys or shafts.

The first scissor-type lift assembly 22 includes a first belt 182 routed through the first path of the first guide arrangement 150. The first belt 182 has a primary end 184 engaged with the first spool 174 onto which the first belt 182 is wound and from which the first belt 182 is unwound. Specifically, the primary end 184 of the first belt 182 is fastened to the first spool base 178. The first belt 182 is coupled to and wound about the first spool base 178 between the first pair of spool flanges 180. The first belt 182 has a secondary end (not shown) engaged with the first engagement shaft 152. It should be appreciated the first belt 182 may be fastened to the first spool 174 in any suitable manner such as being bolted to the first spool 174. It should be appreciated the first belt 182 may be any suitable alternatives such as a rope or a cable.

The first belt 182 is routed through the first path about the first pulley shaft 154 and coupled to the first engagement shaft 152 for reducing the force required to move the first platform 28 between the elevated and lowered states. Specifically, the primary end 184 of the first belt 182 is coupled to the first spool 174 relative to the lower ends 50 of the second arms 46. The first belt 182 extends along the first base 26 towards the lower ends 50 of the first arms 44 and to the first pulley shaft 154. The first belt 182 is disposed about the first pulley 156 of the first engagement shaft 152 and extends between the first arms 44 towards the first pivot axis A1 and is coupled to the first engagement shaft 152.

The first belt 182 is further defined as a plurality of first belts 182 routed through the first path defined by the first guide arrangement 150. The plurality of first belts 182 each have a pair of edges 186. Specifically, the plurality of first belts 182 are defined as three first belts 182 routed through the first path defined by the first guide arrangement 150.

The first scissor-type lift assembly 22 includes a plurality of first rollers 188 movably disposed about the first spool 174. The plurality of first rollers 188 each have a pair of outer surfaces 190. Specifically, the plurality of first rollers 188 are defined as two first rollers 188 disposed about the first spool base 178 between the first pair of spool flanges 180. One of the plurality of first rollers 188 is disposed between two of the plurality of the first belts 182 to align the plurality first belts 182 as the first spool 174 winds and unwinds the plurality first belts 182. The plurality of first rollers 188 are movable along and about the first spool base 178. The plurality of rollers 188 move with the plurality of first belts 182 as the first belts 182 wind and unwind about the first spool base 178. The first pair of outer surfaces 190 of the plurality of rollers abut the pair of edges 186 of the plurality of first belts 182 as the plurality of first belts 182 are wound and unwound to align the plurality of first belts 182 on the first spool base 178. The alignment of the plurality of first belts 182 on the first spool base 178 prevents fraying and deterioration of the plurality of first belts 182.

The first motor 30 is mounted to the first base 26 and is operatively coupled to the first spool 174 to wind and unwind the first belt 182 through the first path to move the first and second pair of scissor arms 40, 42 and move the first platform 28 between the elevated and lowered states. The first motor 30 is coupled to the first spool shaft 176 to rotate the first spool 174 about the first spool axis A3 in a first direction R1 to wind the plurality of first belts 182 onto and about the first spool base 178 to raise the first platform 28. The first motor 30 also rotates the first spool 174 about the first spool axis A3 in a second direction R2 to unwind the plurality of first belts 182 from the first spool base 178 to lower the first platform 28.

As the first and second platforms 28, 34 are in the lowered state, an operator engages the controller 38 to operate the first and second motors 30, 36 in synchronization to raise the first and second platforms 28, 34 to the elevated state. The lift system 20 may be precisely controlled with the first motor 30 of the first scissor-type lift assembly 22 and the second motor 36 of the second scissor-type lift assembly 24 both in communication with and controlled by the controller 38.

As the operator utilizes the controller 38 and initiates the first scissor-lift assembly 22, the first motor 30 rotates the first spool shaft 176 and the first spool 174 about the first spool axis A3 in the first direction R1. As the first spool 174 rotates in the first direction R1, the plurality of first belts 182 are wound about the first spool base 178. The plurality of first rollers 188 guide and align the plurality of first belts 182 onto the first spool base 178. As the plurality of first belts 182 are wound about the first spool base 178, the plurality of first belts 182 exert a force along the first path to engage the first engagement shaft 152. The force moves the first pair of cam followers 166 along the first pair of cams 162 from the lowered cam ends 164 toward the elevated cam ends and moves the first pair of rod followers 168 along the first pair of rods 158 from the lowered rod ends toward the elevated rod ends 160.

As the first pair of cam followers 166 move along the first pair of cams 162 and the first pair of rod followers 168 move along the first pair of rods 158, the first and second pair of scissor arms 40, 42 pivot about the first pivot axis A1 with the lower ends 50 of the first arms 44 moving along the pair of first tracks 52 and the upper arms of the second arms 46 moving along the pair of second tracks. As the first and second pair of scissor arms 40, 42 pivot about the first pivot axis A1, the first platform 28 moves from the lowered state to the elevated state until the operator disengages the controller 38 to cease operation of the first motor 30 or until the first pair of cam followers 166 move along the first pair of cams 162 to the elevated cam ends and the first pair of rod followers 168 move along the first pair of rods 158 to the elevated rod ends 160.

As the first and second platforms 28, 34 are in the elevated state, an operator can utilize the controller 38 to operate the first and second motors 30, 36 to lower the first and second platforms 28, 34 to the lowered state. The operator engages the controller 38 to initiate synchronized operation of the first and second motors 30, 36.

As the operator utilizes the controller 38 and initiates the first scissor-lift assembly 22, the first motor 30 rotates the first spool shaft 176 and the first spool 174 about the first spool axis A3 in the second direction R2. As the first spool 174 rotates in the first direction D2, the plurality of first belts 182 are unwound from the first spool base 178. The plurality of first rollers 188 guide and align the plurality of first belts 182 away the first spool base 178. As the plurality of first belts 182 are unwound about the first spool base 178, the plurality of first belts 182 release the force exerted along the first path to holding the first engagement shaft 152 along the second arms 46. The releasing of the force moves the first pair of cam followers 166 along the first pair of cams 162 from the elevated cam ends toward the lowered cam ends 164 and moves the first pair of rod followers 168 along the first pair of rods 158 from the elevated rod ends 160 toward the lowered rod ends.

As the first pair of cam followers 166 move along the first pair of cams 162 and the first pair of rod followers 168 move along the first pair of rods 158, the first and second pair of scissor arms 40, 42 pivot about the first pivot axis A1 with the lower ends 50 of the first arms 44 moving along the pair of first tracks 52 and the upper arms of the second arms 46 moving along the pair of second tracks. As the first and second pair of scissor arms 40, 42 pivot about the first pivot axis A1, the first platform 28 moves from the elevated state to the lowered state until the operator disengages the controller 38 to cease operation of the first motor 30 or until the first pair of cam followers 166 move along the first pair of cams 162 to the lowered cam ends 164 and the first pair of rod followers 168 move along the first pair of rods 158 to the lowered rod ends.

As the first pair of scissor arms 40 pivot about the first pivot axis A1, the first retention device 96 and the first retention bushing 100 are secured to the first end 60 of the first shaft 58 and engage the first arm 44 of the first pair of scissor arms 40. The first retention device 96 prevents movement of the first shaft 58 along the first pivot axis A1 away from the second pair of scissor arms 42. The first flange 84 and the first bushing 92 engage the second arm 46 of the first pair of scissor arms 40 with the first flange 84 preventing movement of the first shaft 58 along the first pivot axis A1 towards the second pair of scissor arms 42.

The first brace 68 is secured to the second arms 46 of the first pair of scissor arms 40 of the first flange 84 and the first bushing 92 with the second arm 46 of the first pair of scissor arms 40. The engagement of the first flange 84 and the second arm 46 prevents the first shaft 58 from tilting or rocking and retains the first shaft 58 in alignment along the first pivot axis A1 to reduce wear to the first shaft 58 and the first pair of scissor arms 40 as the first pair of scissor arms 40 pivot about the first pivot axis A1.

As the second pair of scissor arms 42 pivot about the first pivot axis A1, the second retention device 142 and the second retention bushing 146 are secured to the third end 106 of the second shaft 104 and engage the first arm 44 of the second pair of scissor arms 42. The second retention device 142 prevents movement of the second shaft 104 along the first pivot axis A1 away from the first pair of scissor arms 40. The second flange 130 and the second bushing 138 engage the second arm 46 of the second pair of scissor arms 42 with the second flange 130 preventing movement of the second shaft 104 along the first pivot axis A1 towards the first pair of scissor arms 40.

The second brace 114 is secured to the second arm 46 of the second pair of scissor arms 42 with the second brace face 116 abutting the second shaft face 110. The second brace 114 applies the compressive force to the second plate 128 to retain the engagement of the second flange 130 and the second bushing 138 with the second arm 46 of the second pair of scissor arms 42. The engagement of the second flange 130 and the second arm 46 prevents the second shaft 104 from tilting or rocking and retains the second shaft 104 in alignment along the first pivot axis A1 to reduce wear to the second shaft 104 and the second pair of scissor arms 42 as the second pair of scissor arms 40 pivot about the first pivot axis A1.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A scissor-type lift assembly comprising:

a base;

a platform coupled to said base for movement between elevated and lowered states in which said platform and said base are distant and proximate, respectively;

a first pair of scissor arms each having upper and lower ends respectively coupled to each of said platform and said base, said first pair of scissor arms pivotably connected to each other intermediate their respective upper and lower ends about a first pivot axis;

a first shaft disposed along said first pivot axis, and having a first end and a second end spaced from said first end along said first pivot axis with said first pair of scissor arms pivotably disposed about said first shaft, and said first and second ends extending from said first pair of scissor arms with said second end terminating at a first shaft face;

a first retention device coupled to said first end of said first shaft with said first retention device engaging one of said first pair of scissor arms;

a second pair of scissor arms each having upper and lower ends respectively coupled to each of said platform and said base, said second pair of scissor arms pivotably connected to each other intermediate their respective upper and lower ends about the first pivot axis;

a second shaft disposed along said first pivot axis, and having a third end and a fourth end spaced from said third end along said first pivot axis with said second pair of scissor arms pivotably disposed about said second shaft, and said third and fourth ends extending from said second pair of scissor arms with said fourth end terminating at a second shaft face;

a second retention device coupled to said third end of said second shaft with said second retention device engaging one of said second pair of scissor arms; and a first brace fixed to another one of said first pair of scissor arms with said first brace abutting said first shaft face of said first shaft to maintain alignment of said first shaft along said first pivot axis for reducing wear between said first pivot axis and said first pair of scissor arms; and a second brace fixed to another one of said second pair of scissor arms with said second brace abutting said second shaft face of said second shaft to maintain alignment of said second shaft along said first pivot axis for reducing wear between said first pivot axis and said second pair of scissor arms;

wherein said first brace has a first central portion and a first support portion extending from said first central portion toward said another one of said first pair of scissor arms to define a first gap between said first central portion and said another of said first pair of scissor arms with said first shaft face disposed in said first gap, and wherein said second brace has a second central portion and a second support portion extending from said second central portion toward said another one of said second pair of scissor arms to define a second gap between said second central portion and said another of said second pair of scissor arms with said second shaft face disposed in said second gap.

2. The scissor-type lift assembly as set forth in claim 1 wherein;

said first brace has opposing distal ends and said first support portion is further defined as a pair of first support portions with one of said pair of first support portions extending from each of said distal ends of said first brace, and said second brace has opposing distal ends and said second support portion is further defined as a pair of second support portions with one of said pair of second support portions extending from each of said distal ends of said second brace.

3. The scissor-type lift assembly as set forth in claim 2 further including;

a first plurality of fasteners extending through said pair of first support portions to secure said first brace to said another one of said first pair of scissor arms, and a second plurality of fasteners extending through said pair of second support portions to secure said second brace to said another one of said second pair of scissor arms.

4. The scissor-type lift assembly as set forth in claim 1 wherein;

said first shaft defines a first groove about said first end with said first retention device disposed about said first shaft and aligned with said first groove, and said second shaft defines a second groove about said third end with said second retention device disposed about said second shaft and aligned with said second groove.

5. The scissor-type lift assembly as set forth in claim 4 further including;

a first retention fastener extending through said first retention device and disposed in said first groove of said first shaft to secure said first retention device to said first shaft, and a second retention fastener extending through said second retention device and disposed in said second groove of said second shaft to secure said second retention device to said second shaft.

6. The scissor-type lift assembly as set forth in claim 1 wherein;

said first shaft has a first removal feature defined in said second end for removing said first shaft from said first pair of scissor arms, and said second shaft has a second removal feature defined in said fourth end for removing said second shaft from said second pair of scissor arms.

7. The scissor-type lift assembly as set forth in claim 1 further including;

a first spacer disposed about said first shaft between said first pair of scissor arms to space said first pair of scissor arms from each other along said first pivot axis, and a second spacer disposed about said second shaft between said second pair of scissor arms to space said second pair of scissor arms from each other along said first pivot axis.

8. A scissor-type lift assembly comprising:

a base;

a platform coupled to said base for movement between elevated and lowered states in which said platform and said base are distant and proximate, respectively;

a first pair of scissor arms each having upper and lower ends respectively coupled to each of said platform and said base, said first pair of scissor arms pivotably connected to each other intermediate their respective upper and lower ends about a first pivot axis;

a first shaft disposed along said first pivot axis, and having a first end and a second end spaced from said first end along said first pivot axis with said first pair of scissor arms pivotably disposed about said first shaft, and said first and second ends extending from said first pair of scissor arms with said second end terminating at a first shaft face;

a first retention device coupled to said first end of said first shaft with said first retention device engaging one of said first pair of scissor arms;

a second pair of scissor arms each having upper and lower ends respectively coupled to each of said platform and said base, said second pair of scissor arms pivotably connected to each other intermediate their respective upper and lower ends about the first pivot axis;

a second shaft disposed along said first pivot axis, and having a third end and a fourth end spaced from said third end along said first pivot axis with said second pair of scissor arms pivotably disposed about said second shaft, and said third and fourth ends extending from said second pair of scissor arms with said fourth end terminating at a second shaft face;

a second retention device coupled to said third end of said second shaft with said second retention device engaging one of said second pair of scissor arms; and a first brace fixed to another one of said first pair of scissor arms with said first brace abutting said first shaft face of said first shaft to maintain alignment of said first shaft along said first pivot axis for reducing wear between said first pivot axis and said first pair of scissor arms;

a second brace fixed to another one of said second pair of scissor arms with said second brace abutting said second shaft face of said second shaft to maintain alignment of said second shaft along said first pivot axis for reducing wear between said first pivot axis and said second pair of scissor arms;

a first flange coupled to said first shaft to further define said first shaft face and further maintain alignment of said first shaft along said first pivot axis for reducing wear between said first pivot axis and said first pair of scissor arms; and a second flange coupled to said second shaft to further define said second shaft face and further maintain alignment of said second shaft along said first pivot axis for reducing wear between said first pivot axis and said second pair of scissor arms.

9. The scissor-type lift assembly as set forth in claim 8 wherein;

said first shaft has a first shaft periphery and said first flange has a first flange periphery with said first flange periphery disposed radially further from said first pivot axis than said first shaft periphery to further maintain alignment of said first shaft along said first pivot axis for reducing wear between said first pivot axis and said first pair of scissor arms, and said second shaft has a second shaft periphery and said second flange has a second flange periphery with said second flange periphery disposed radially further from said first pivot axis than said second shaft periphery to further maintain alignment of said second shaft along said first pivot axis for reducing wear between said first pivot axis and said second pair of scissor arms.

10. The scissor-type lift assembly as set forth in claim 8 further including;

a first bushing disposed between said first flange and said another one of said first pair of scissor arms to reduce friction between said first flange and said another one of said first pair of scissor arms as said first pair of scissor arms pivots about said first pivot axis, and a second bushing disposed between said second flange and said another one of said second pair of scissor arms to reduce friction between said second flange and said another one of said second pair of scissor arms as said second pair of scissor arms pivots about said first pivot axis.

11. The scissor-type lift assembly as set forth in claim 8 further including;

a first plate coupled to said first flange to further define said first shaft face and to further maintain alignment of said first shaft along said first pivot axis for reducing wear between said first pivot axis and said first pair of scissor arms, and a second plate coupled to said second flange to further define said second shaft face and to further maintain alignment of said second shaft along said first pivot axis for reducing wear between said first pivot axis and said second pair of scissor arms.

12. The scissor-type lift assembly as set forth in claim 8 wherein;

said first shaft defines a first groove about said first end with said first retention device disposed about said first shaft and aligned with said first groove, and said second shaft defines a second groove about said third end with said second retention device disposed about said second shaft and aligned with said second groove.

13. The scissor-type lift assembly as set forth in claim 12 further including;

a first retention fastener extending through said first retention device and disposed in said first groove of said first shaft to secure said first retention device to said first shaft, and a second retention fastener extending through said second retention device and disposed in said second groove of said second shaft to secure said second retention device to said second shaft.

14. The scissor-type lift assembly as set forth in claim 8 wherein;

said first shaft has a first removal feature defined in said second end for removing said first shaft from said first pair of scissor arms, and said second shaft has a second removal feature defined in said fourth end for removing said second shaft from said second pair of scissor arms.

15. The scissor-type lift assembly as set forth in claim 8 further including;

a first spacer disposed about said first shaft between said first pair of scissor arms to space said first pair of scissor arms from each other along said first pivot axis, and a second spacer disposed about said second shaft between said second pair of scissor arms to space said second pair of scissor arms from each other along said first pivot axis.

* * * * *